US005982281A

United States Patent [19]

Layson, Jr.

[11] Patent Number: 5,982,281

[45] **Date of Patent: *Nov. 9, 1999**

[54] OFFENDER AND VICTIM COLLISION AVOIDANCE AND ADVANCED WARNING SYSTEM

[75] Inventor: Hoyt M. Layson, Jr., Palm Harbor, Fla.

[73] Assignee: Pro Tech Monitoring, Inc., Palm Harbor, Fla.

[ * ] Notice: This patent is subject to a terminal disclaimer.

[21] Appl. No.: 09/082,313

[22] Filed: May 2, 1998

[51] Int. Cl.[6] ..... G08B 21/00; G08B 1/08

[52] U.S. Cl. ..... 340/539; 340/825.36; 340/825.49; 340/573.1; 340/573.4; 379/38

[58] Field of Search ..... 340/539, 825.49, 340/825.36, 573.1, 573.4; 379/38; 342/357, 457

[56] References Cited

U.S. PATENT DOCUMENTS 5,461,390 10/1995 Hoshen ..... 340/825.49
5,497,149 3/1996 Fast ..... 340/426
5,594,425 1/1997 Ladner et al. ..... 340/825.49
5,627,548 5/1997 Woo et al. ..... 342/357
5,731,757 3/1998 Layson, Jr. ..... 340/825.49
5,742,233 4/1998 Hoffman et al. ..... 340/825.49

*Primary Examiner*—Donnie L. Crosland
*Attorney, Agent, or Firm*—Larson & Larson, P.A.; James E. Larson

[57] ABSTRACT

A redundant system is provided for simultaneously notifying a victim about the approach of an offender when a message is sent to a central data base. The system includes multiple communication paths and assured message delivery. The offender's portable tracking apparatus is equipped with a memory card that sends and receives data and instruction to/from a central data base. The offender's position, determined by a Global Position System, is communicated simultaneously to a victim's portable tracking apparatus, to the central data base, law enforcement and the offender's supervisory authority. A connectionless oriented analog or digital wireless or circuit switched connection oriented digital or analog wireless signal is employed.

22 Claims, 17 Drawing Sheets

OFFENDER AND VICTIM COLLISION AVOIDANCE AND ADVANCED WARNING SYSTEM

BACKGROUND OF THE INVENTION

1. Field of the Invention

This invention relates to electronic monitoring and tracking of persons. More particularly, it refers to a system for providing advanced warning to victims and concurrently delivering immediate instructional commands to offenders, and timely notification to an offender supervising and law enforcement agency should an offender and victim come within an unallowable proximity of one another.

2. Description of Prior Art

Determining the location of a person or subject, such as an offender or victim, is possible outside the confines of their respective residence according to the method described in U.S. Pat. No. 5,731,757. The apparatus employed in the method is a tamper resistant body worn ankle wireless transmitter communicating with an associated tamper resistant portable tracking apparatus. The portable tracking apparatus determines its location using Global Positioning System (GPS) satellites. The portable tracking apparatus communicates with a central data base system using wireless communications when portable, and using land-line communications when placed in a charging stand at the subject's residence or work location. Algorithms in the offender's portable tracking apparatus executing on the processor compare the offender's current location against a schedule of location rules stored in the memory of the offender's portable tracking apparatus.

In order to provide dynamic safety perimeters for the victim (i.e. a safety perimeter that moves with the victim), both the offender's portable tracking apparatus and the victim's portable tracking apparatus must establish frequent wireless communication connections with the central data base system to maintain a location, health and status, hereinafter defined as heartbeat, to support location data fusion processing at the central data base system. Frequent wireless communication connections to the central data base system are required since the central data base system performs the location data fusion processing necessary to determine violation of the victim's dynamic safety perimeters as the location of the victim changes. The central data base system also notifies victims, supervising agencies and law enforcement agencies regarding the health and status of the offender's portable tracking apparatus and body worn device.

Other prior art portable locating apparatus using satellite signals and providing notification based on a location do not consider the issues of latency of data transfer or cost effective wireless data transfer associated with subject collision avoidance using a wireless portable locating apparatus. Such apparatus can be seen in U.S. Pat. Nos. 5,594,425, 5,627,548, and 5,497,149.

Another approach to obtaining location, health and status is to poll the offender's and victim's portable tracking apparatus by placing a cellular phone call to the apparatus as described in U.S. Pat. No. 5,461,390. This centralized polling approach increases notification time to the victim. Frequent cellular phone calls to the offender and victim portable tracking apparatus determines location, health and status. This will incur significant wireless cost.

In the prior art, a central data base system is responsible for a location data fusion processing and notifications. This requires multiple communication sessions in order to report violations to victims' supervising agencies and law enforcement agencies. A single point of failure in such multiple communication sessions results in total system failure.

Recently, digital wireless services have incorporated packet message capability which do not require establishing a full duplex (i.e. two-way) connection between a sender and a receiver before transferring digital information. The industry term for this type of analog or digital wireless service is called connectionless oriented service. An example of an implemented connectionless oriented wireless service is cellular digital packet data (CDPD). Devices that commonly use CDPD and other forms of connectionless oriented services are alphanumeric pagers, two way alphanumeric pagers and wireless personal communication services (PCS) such as mobile data terminals and mobile fax machines.

Currently, Transport Connection Protocol/Internet Protocol (TCP/IP) packets are used to route wireless data packets from source to destination. Since the allocation of a send and receive wireless channel for a typical connection oriented full duplex communication session supporting ring, answer, data transfer and hang-up is not required for packetized connectionless oriented analog or digital wireless services, the data transfer is faster, shorter in duration and more cost effective. Devices that support connectionless oriented analog or digital wireless services include pagers, digital cellular phones and PCS devices. TCP/IP packets can also be routed between the wireless network, private land based networks, public switched telephone networks and the Internet enabling devices attached to the Internet, a public network or a private network to communicate directly with wireless devices and the portable tracking device referenced in U.S. Pat. No. 5,731,757.

The problem with a connectionless oriented analog or digital wireless message is that there is no end-to-end verification that a message is successfully delivered since there is only a half duplex (i.e. a transmit channel) connection between the source and destination for the message. This problem is further compounded for wireless applications because wireless media is less reliable and more susceptible to interference than wire or fiber optic media. Forward error correction, as is known in the art, can detect and correct some interference problems, but dropped packets due to severe interference or equipment failures between source and destination cannot be recovered.

There exists a need to reduce the wireless connection time between a subject's (i.e. offender or victim) portable tracking apparatus and a central data base system to provide more timely location, health and status data (i.e. heartbeat) in a cost-effective manner. In the case of an offender and associated victims, there exists a need for the offender's portable tracking apparatus and victim's portable tracking apparatus to communicate location, health and status data directly to each other rather than only relying on being relayed through the central data base system. The portable tracking apparatus also needs to perform location data fusion processing to eliminate the latency time and wireless communications cost associated with location data fusion processing being performed at a central data base system using multiple connection oriented circuit switched wireless communications. In the case of offender violation notifications to offender supervising agencies, law enforcement agencies and victims, there exists a need for direct communications between an offender's portable tracking apparatus and notification devices (i.e. pagers, digital cellular phones, mobile data terminals, etc.) with supervising agencies, law enforcement agencies and victims. In the case of notifications generated by a victim's portable tracking apparatus to offender supervising agencies and law enforcement agencies, there exists a need for direct communications between a victim's portable tracking apparatus and notification devices (i.e. pagers, digital cellular phones, mobile data terminals, etc.) with supervising agencies and law enforcement agencies. In the case of assured message delivery, end-to-end verification of data delivery is needed to assure victims are warned, supervising and law enforcement agencies are notified and the central data base system stores offender and victim location, health and status data, especially where violations have occurred.

SUMMARY OF THE INVENTION

The offender and victim location, health and status data latency problem incurred by using connection oriented wireless services to a central data base system is solved by this invention. The method of this invention employs connectionless oriented analog or digital wireless service and performs location data fusion processing within a portable tracking apparatus. The costly manner of determining the location, health and status (i.e. performing a heartbeat function) of a portable tracking apparatus by a central data base system using connection oriented wireless service is solved by this invention using connectionless oriented analog or digital wireless service. Notification latency time for offender supervising agencies, law enforcement agencies and victims is solved by this invention using connectionless oriented analog or digital wireless services.

The method of this invention results in communications capability of connectionless oriented analog or digital wireless service:

- directly between multiple portable tracking apparatuses (i.e. offenders and victims),
- directly between the central data base system and the wireless personal communication service notification devices with the supervising agencies, law enforcement agencies and victims,
- directly between the portable tracking apparatus and the central data base system and
- directly between the portable tracking apparatus and the wireless personal communication service notification devices with the supervising agencies, law enforcement agencies and victims.

The method provides a more reliable and immediate advanced notification system for the central data base system, supervising agencies, law enforcement agencies and victims. Implementing location data fusion processing in the portable tracking device, augments the location data fusion processing in the central data base system. This eliminates the latency time associated with placing two or more connection oriented data transfers between the central data base system and offender's portable tracking apparatus and victims portable tracking apparatus.

The method provides a significantly higher frequency of portable tracking apparatus reporting of location, health and status (i.e. heartbeat) data. This higher frequency of reporting by the portable tracking apparatus allows both the central data base system and other portable tracking apparatus to more reliably track an offender or victim. The higher frequency of portable tracking apparatus reporting provides improved surveillance for supervising agencies and law enforcement agencies.

The capability of the offender's portable tracking apparatus to communicate directly to the supervising agency's, law enforcement agency's and victim's notification device using connectionless oriented analog or digital wireless services reduces notification latency time related to offender violations. Augmenting the central data base system as the only notification relay between the offender's portable tracking apparatus and the notification devices with the supervising agency, law enforcement agency and victims, eliminates the latency time associated with placing two or more connection oriented data transfers between the offender's portable tracking apparatus, central data base system and notification devices.

The lack of end-to-end confirmation of connectionless oriented analog or digital wireless message delivery is solved in this method by the portable tracking device and central data base system implementing acknowledgments for each connectionless oriented analog or digital wireless message. Connectionless oriented analog or digital wireless message acknowledgments provided by the portable tracking apparatus and the central data base system assure message delivery between:

- multiple portable tracking apparatus (i.e. offenders and victims),
- central data base system and portable tracking apparatus,
- portable tracking apparatus and wireless notification devices (i.e. PCS and two-way digital alphanumeric pagers), and
- central data base system and wireless notification devices (i.e. PCS and two-way digital alphanumeric pagers).

Wireless notification devices such as two-way digital alphanumeric pagers and PCS devices provide an acknowledgment of message delivery to the portable tracking apparatus and the central data base system when the operator responds to the message.

The reliability and fault tolerance of the end-to-end communications between:

- multiple portable tracking apparatuses (i.e. offenders and victims),
- central data base system and portable tracking apparatus,
- portable tracking apparatus and wireless notification devices (i.e. PCS and two-way digital alphanumeric pagers), and
- central data base system and wireless notification devices (i.e. PCS and two-way digital alphanumeric pagers), is improved by implementing a mesh communications topology (i.e. device to device directly and device to device via central data base system) as opposed to a single string communications topology. The mesh topology using connectionless oriented analog or digital wireless services provides local communication capability between all devices except the central data base system reducing long distance costs and reducing the number of elements required for end-to-end communications.

BRIEF DESCRIPTION OF THE DRAWINGS

The invention can best be understood by those having ordinary skill in the art by reference to the following detailed description when considered in conjunction with the accompanying drawings in which.

DETAILED DESCRIPTION

Figure 1:
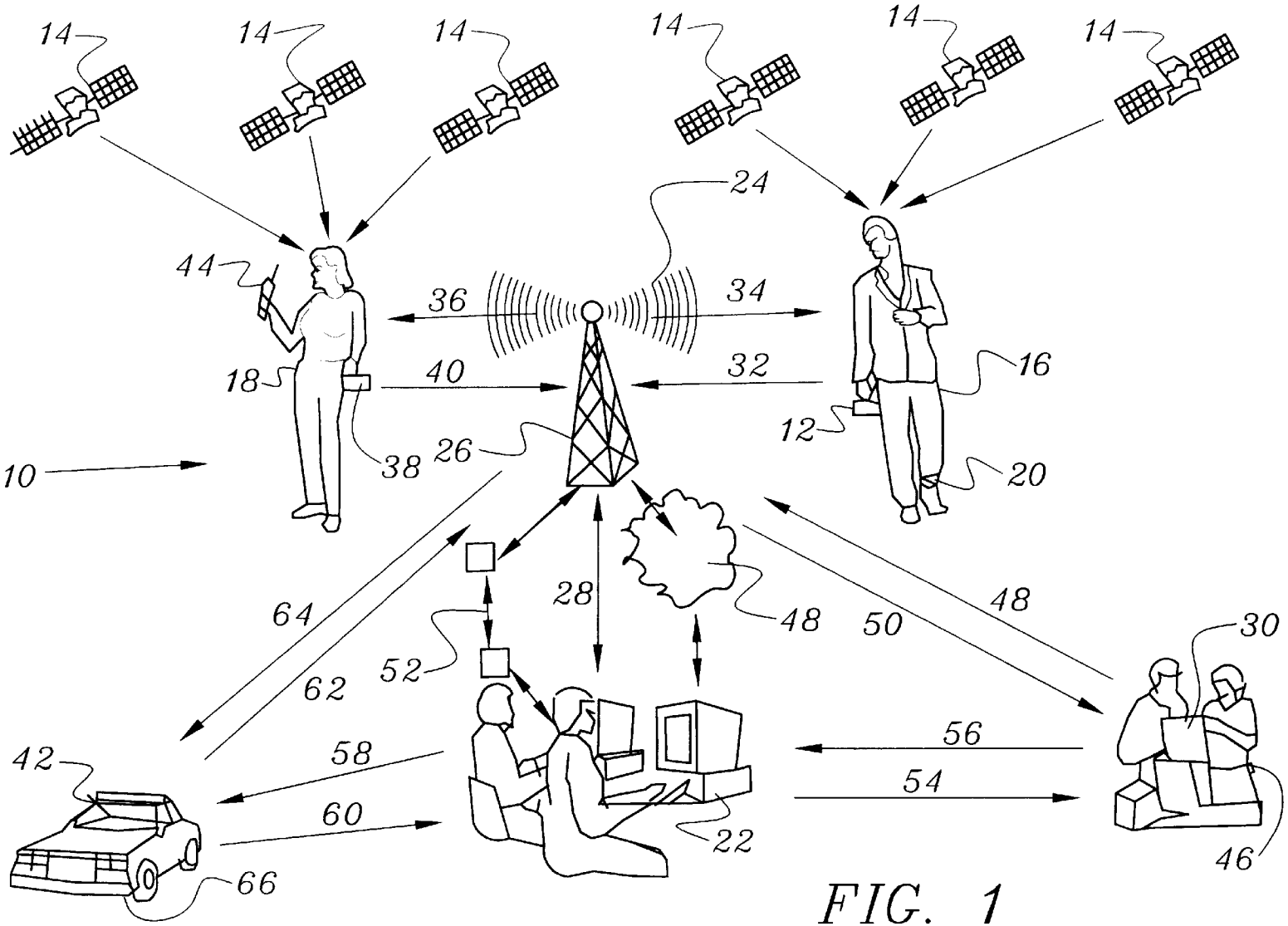
FIG. 1 is a diagram describing the major elements of the system incorporating the portable tracking apparatus.
Figure 2A:
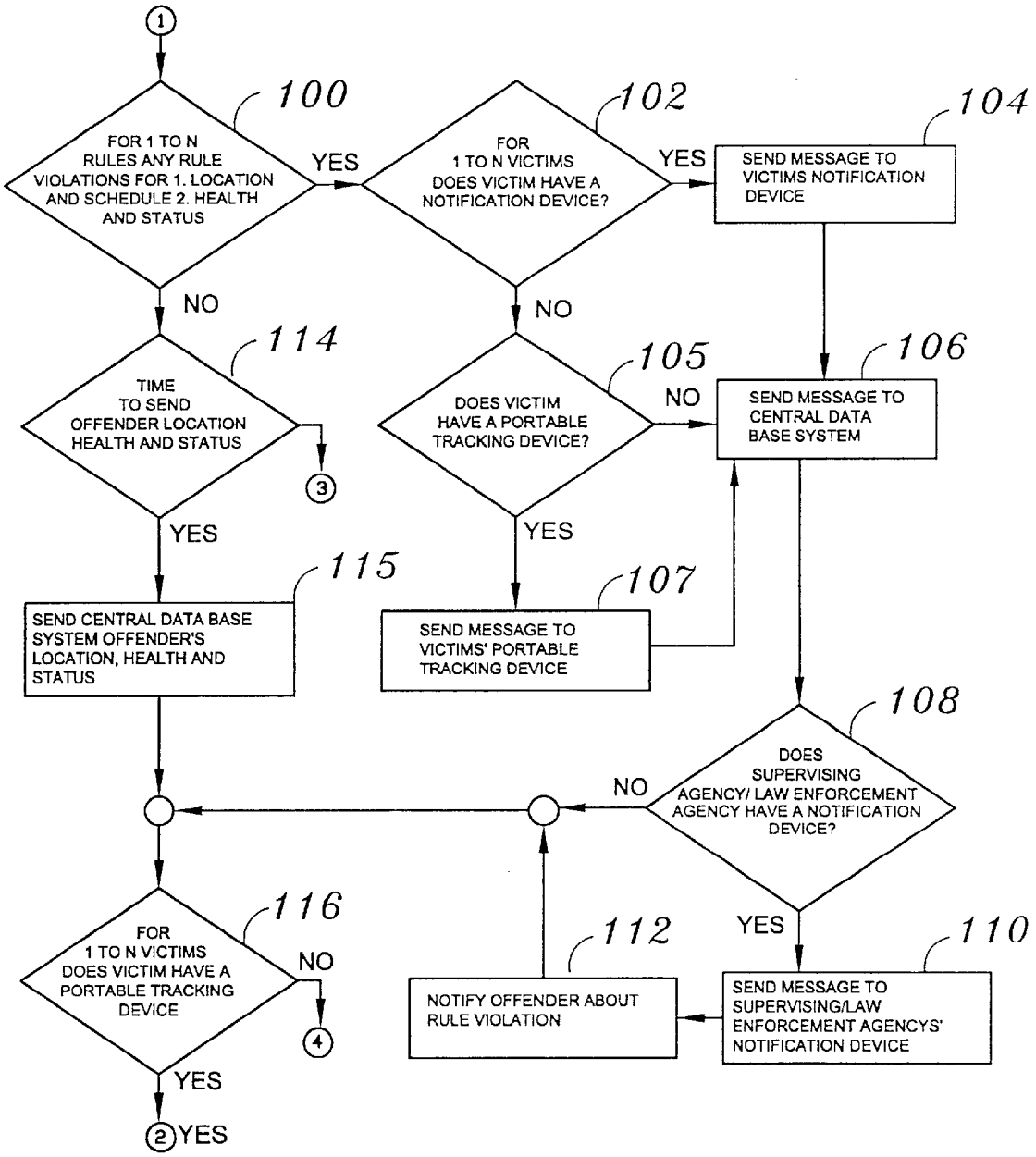
FIGS. 2A–2E are flowcharts of the method of operation of the offender's portable tracking apparatus.
Figure 2B:
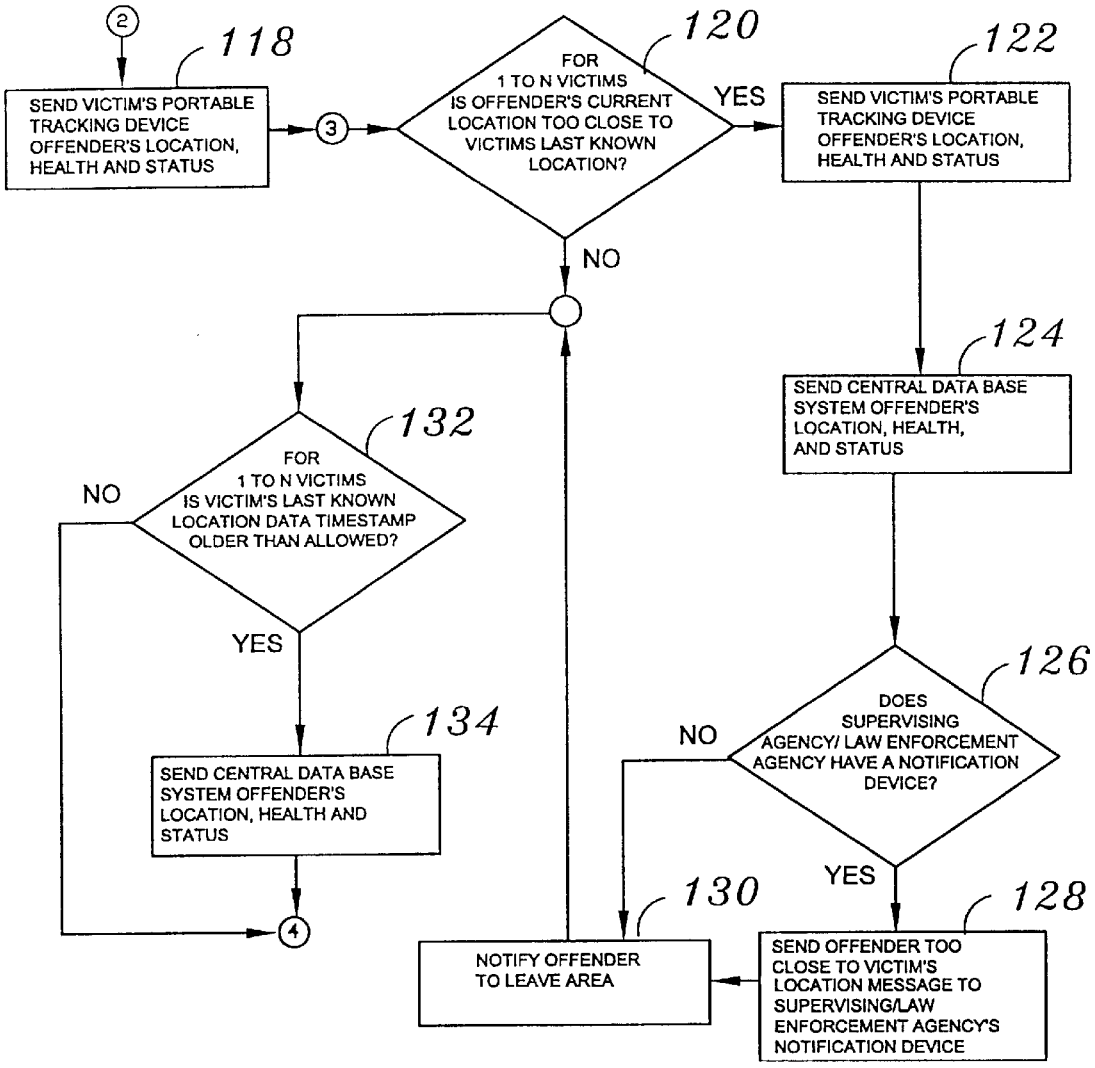
Figure 2C:
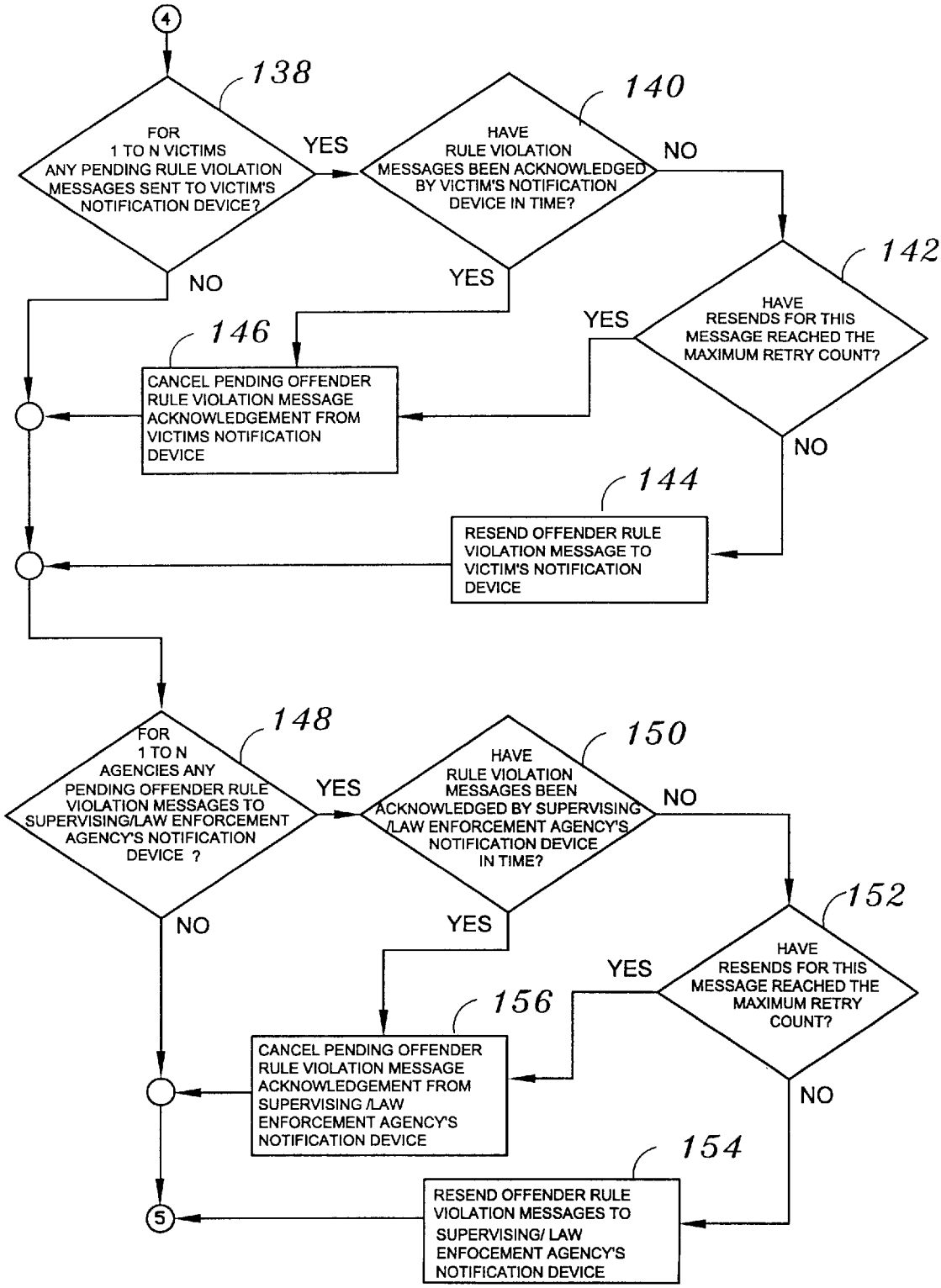
Figure 2D:
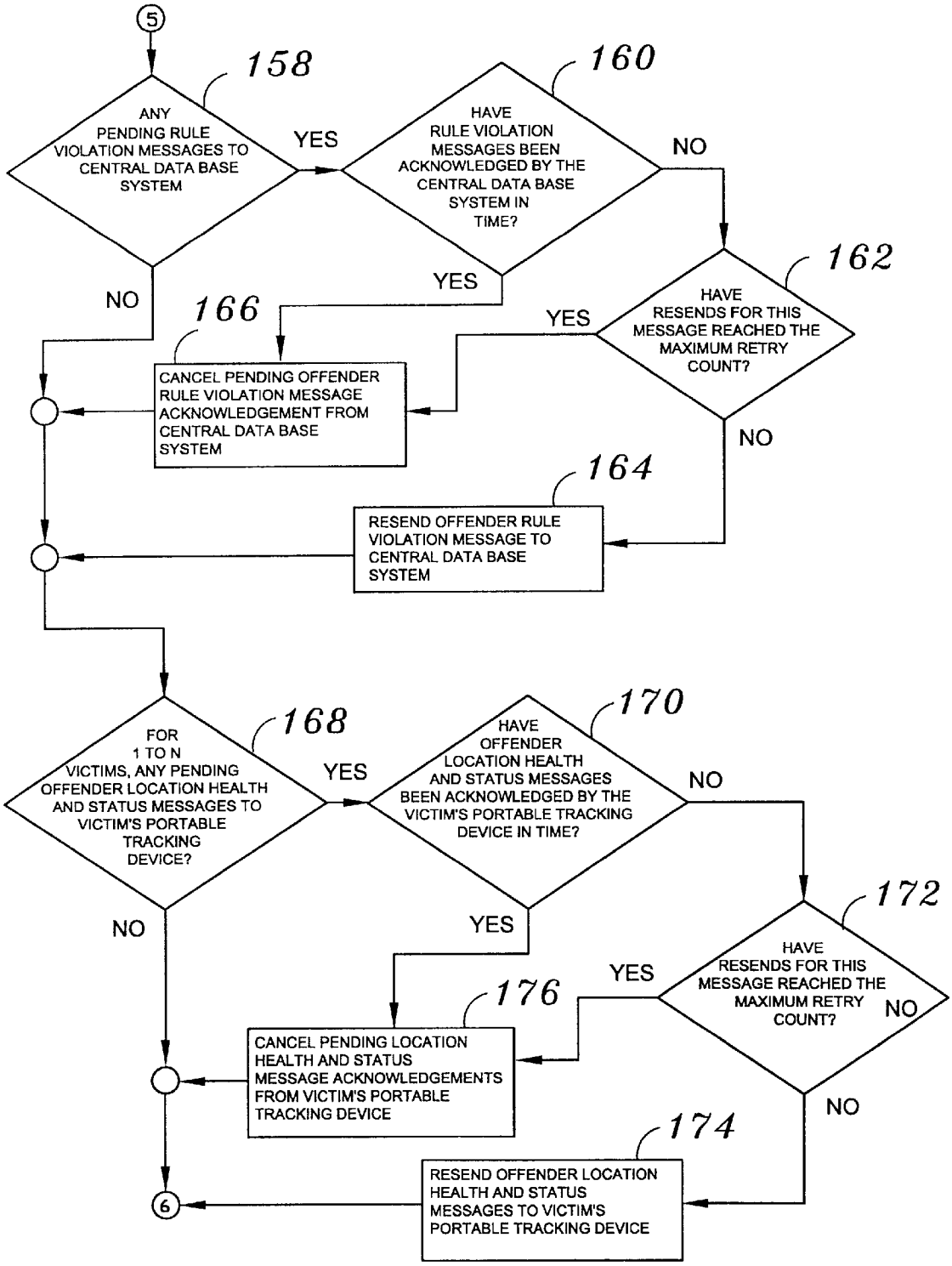
Figure 2E:
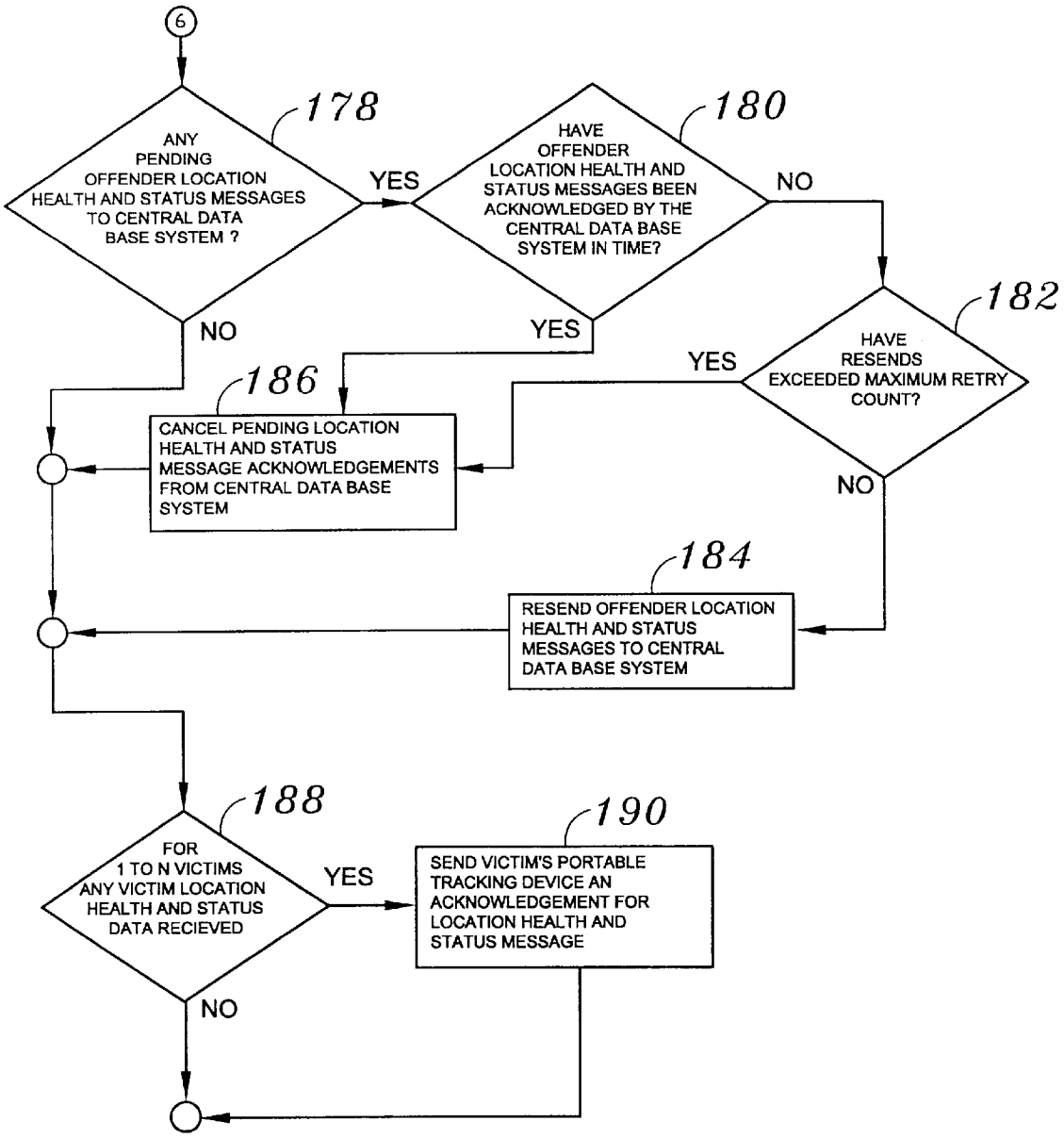
Figure 3A:
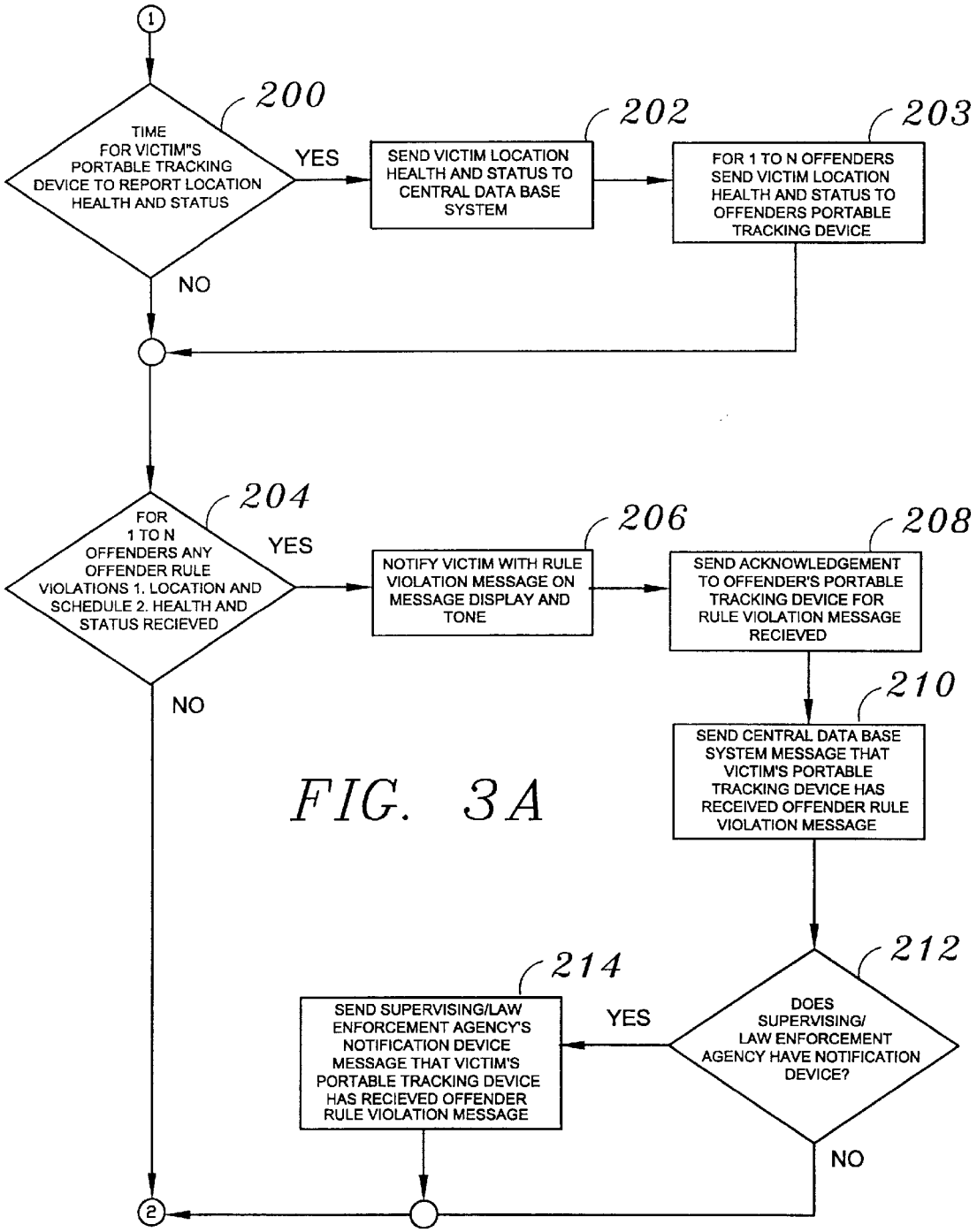
FIGS. 3A–3E are flowcharts of the method of operation of the victim's portable tracking apparatus.
Figure 3B:
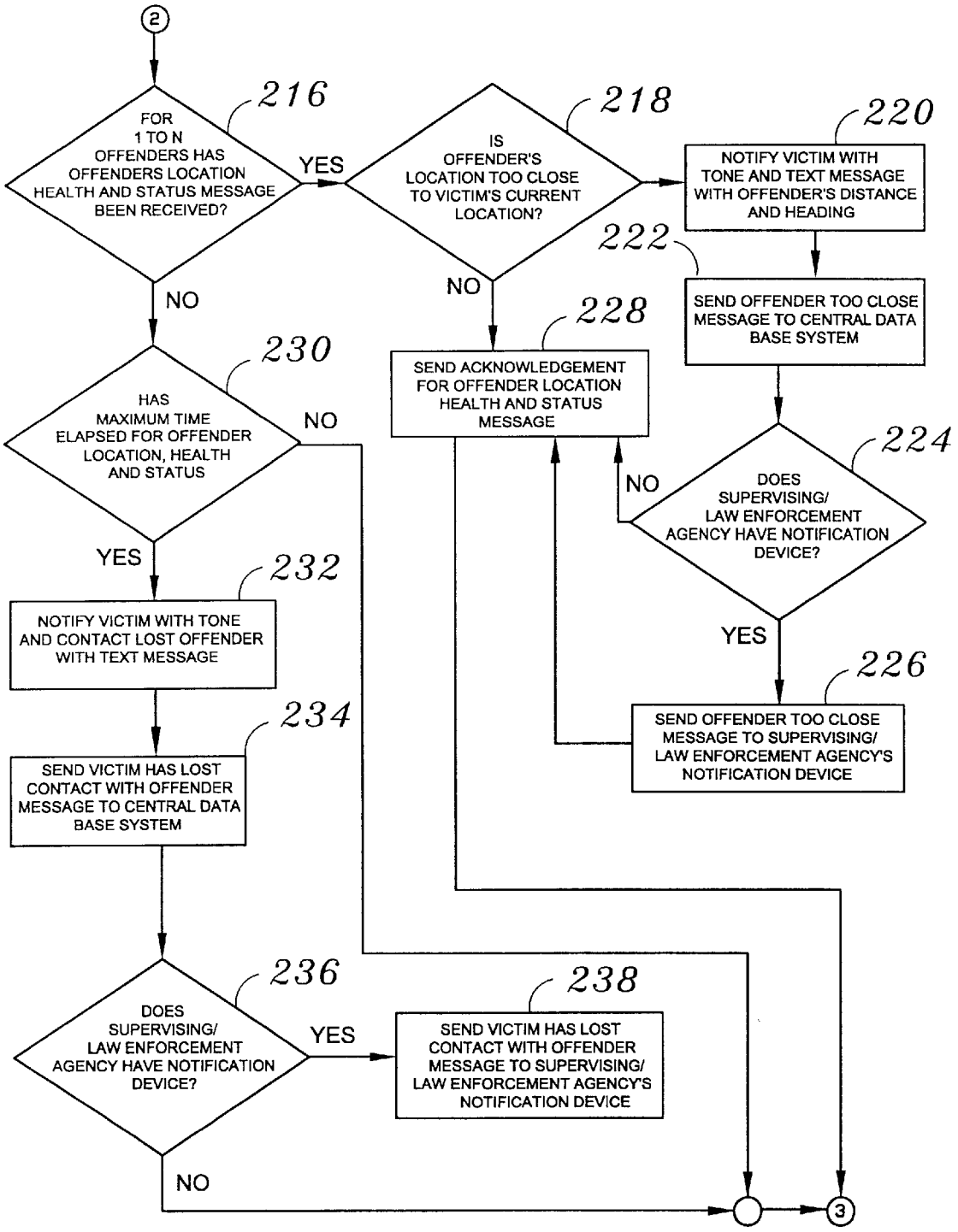
Figure 3C:
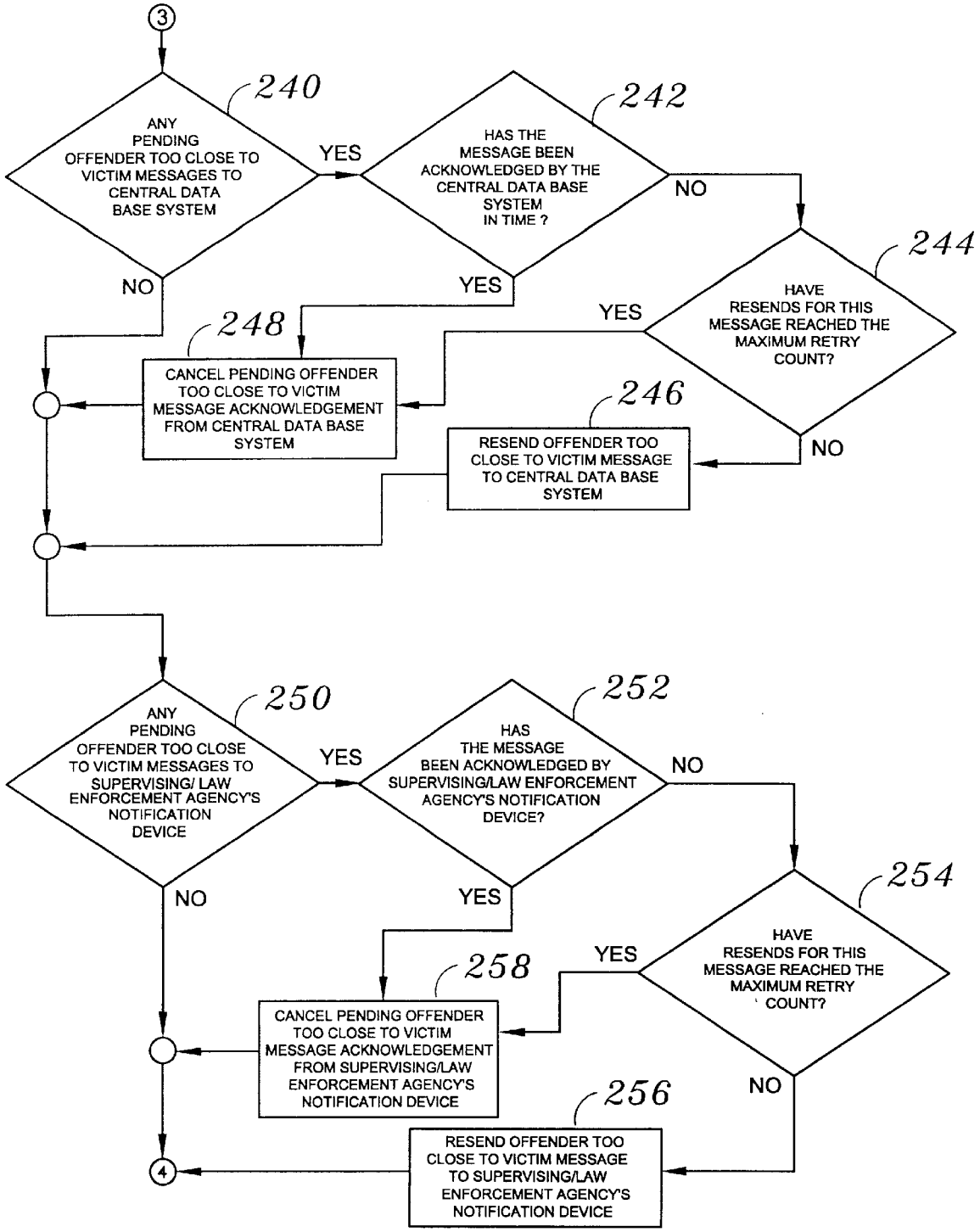
Figure 3D:
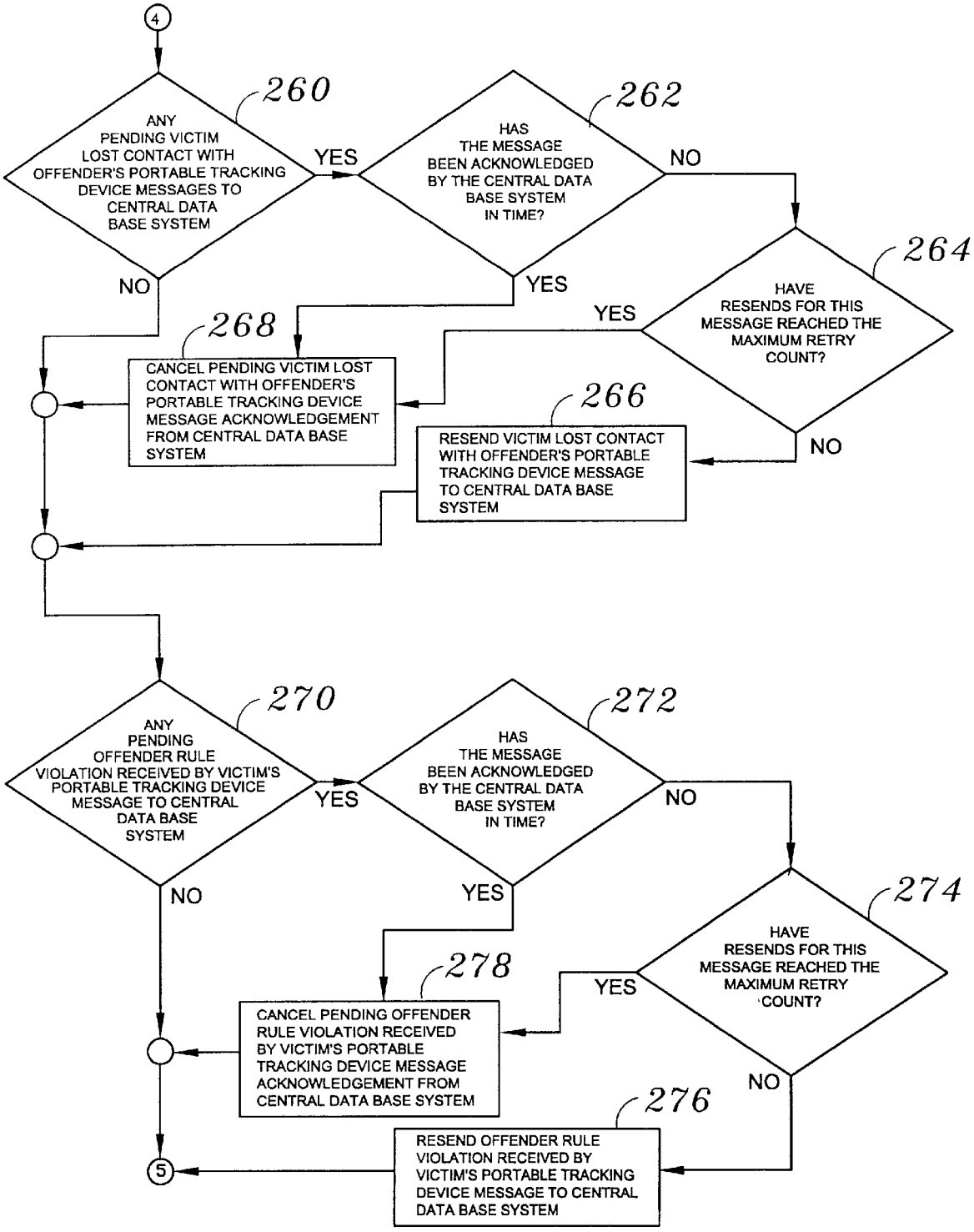
Figure 3E:
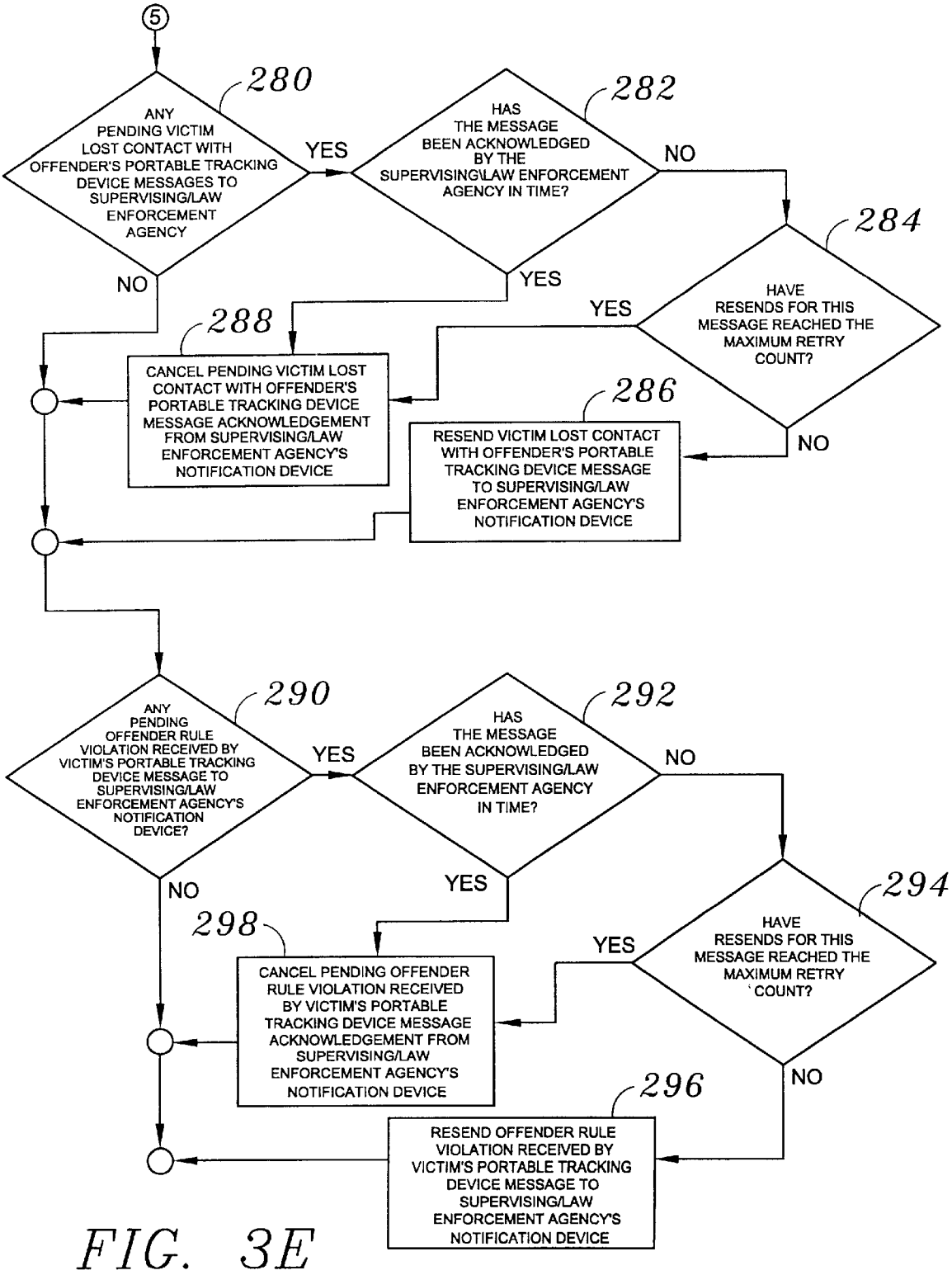
Figure 4A:
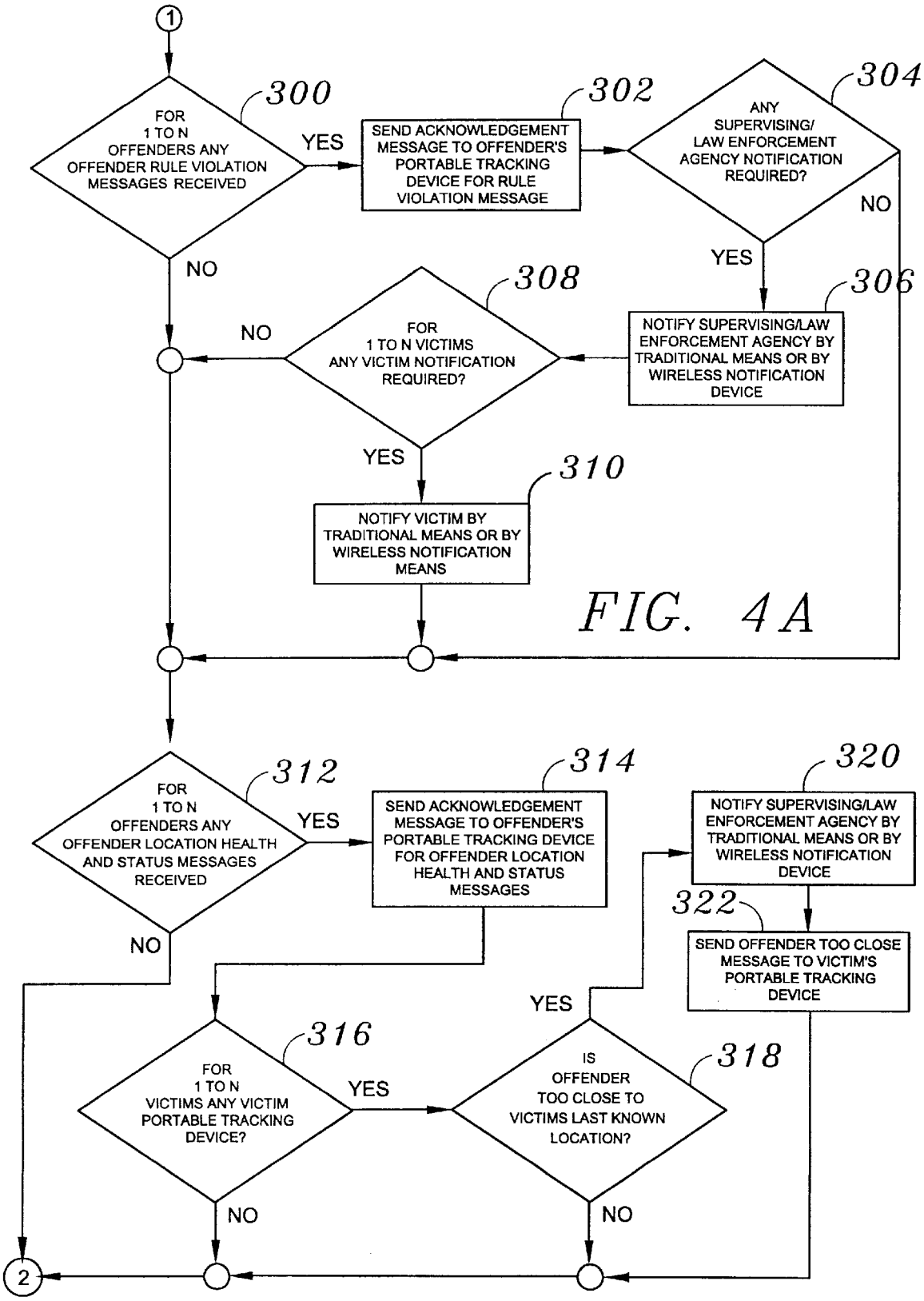
FIGS. 4A–4F are flowcharts of the method of operation of the data base system.
Figure 4B:
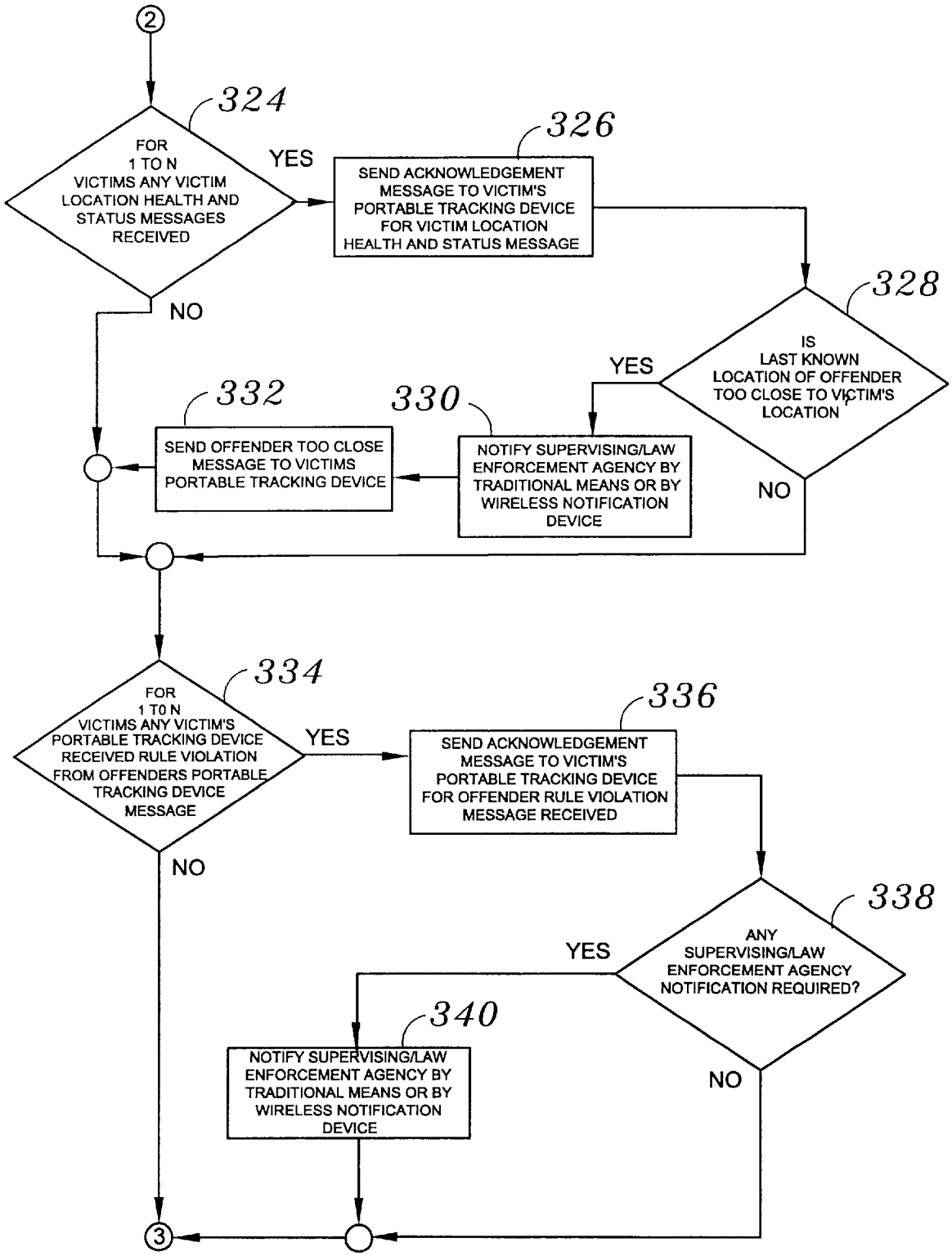
Figure 4C:
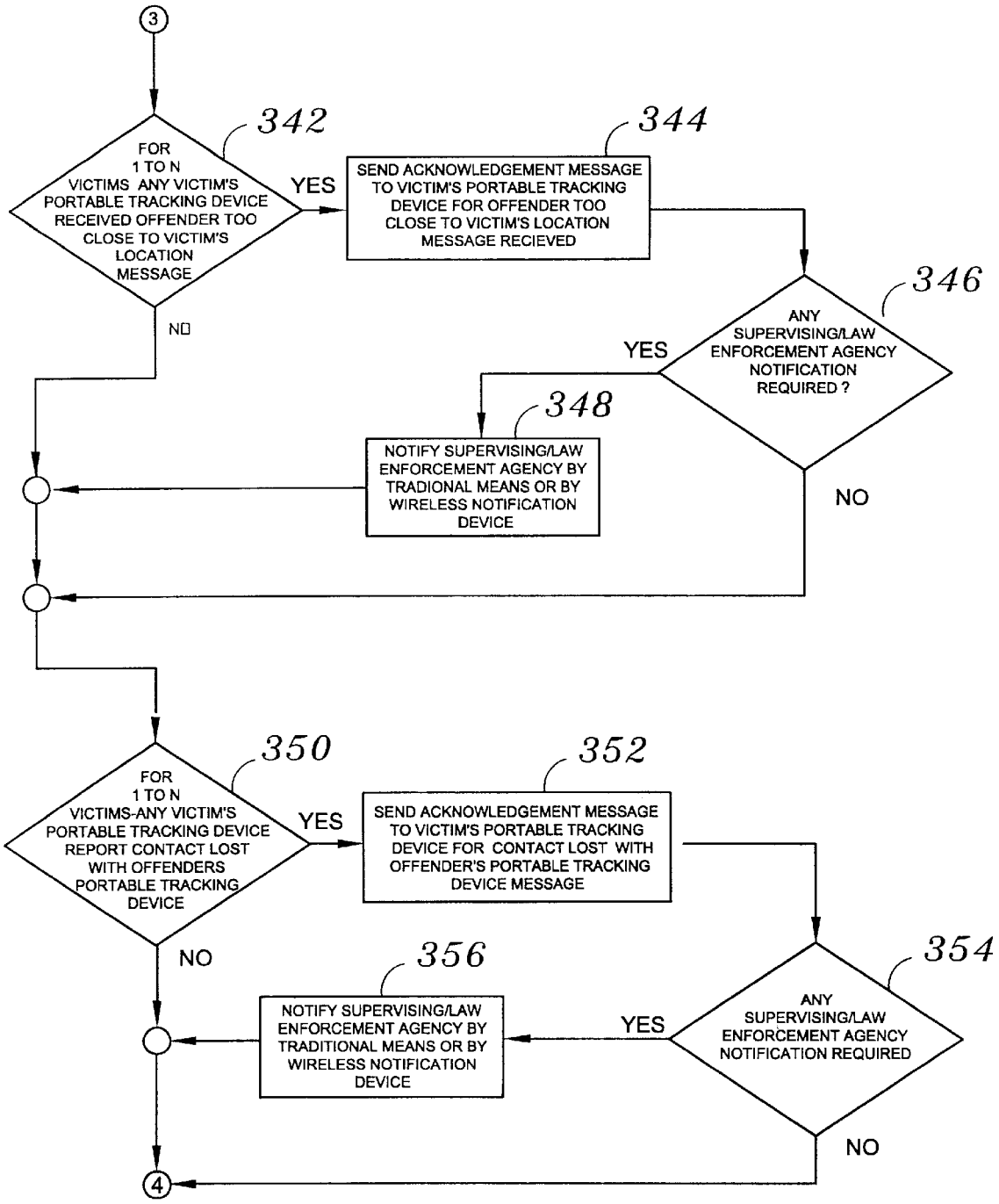
Figure 4D:
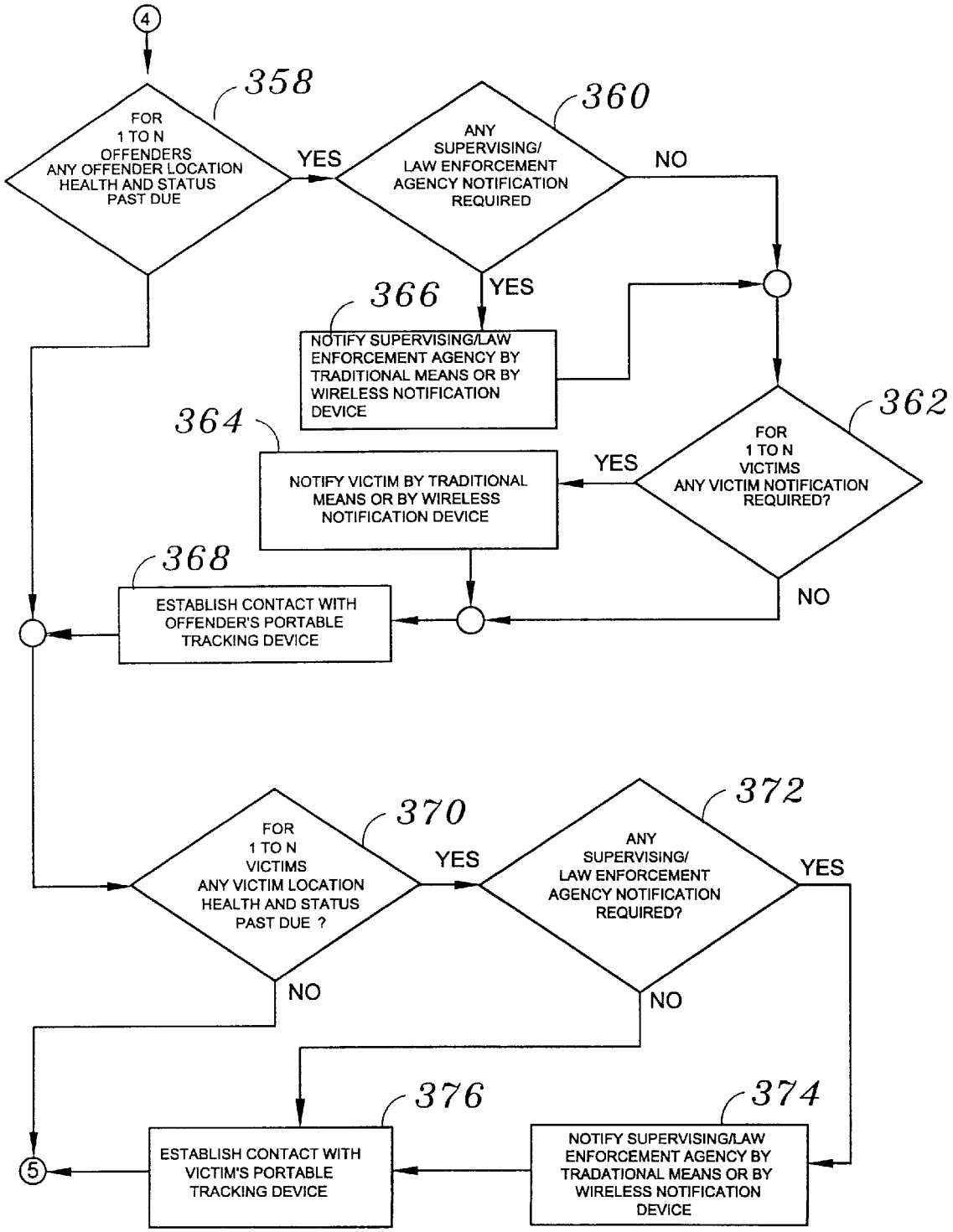
Figure 4E:
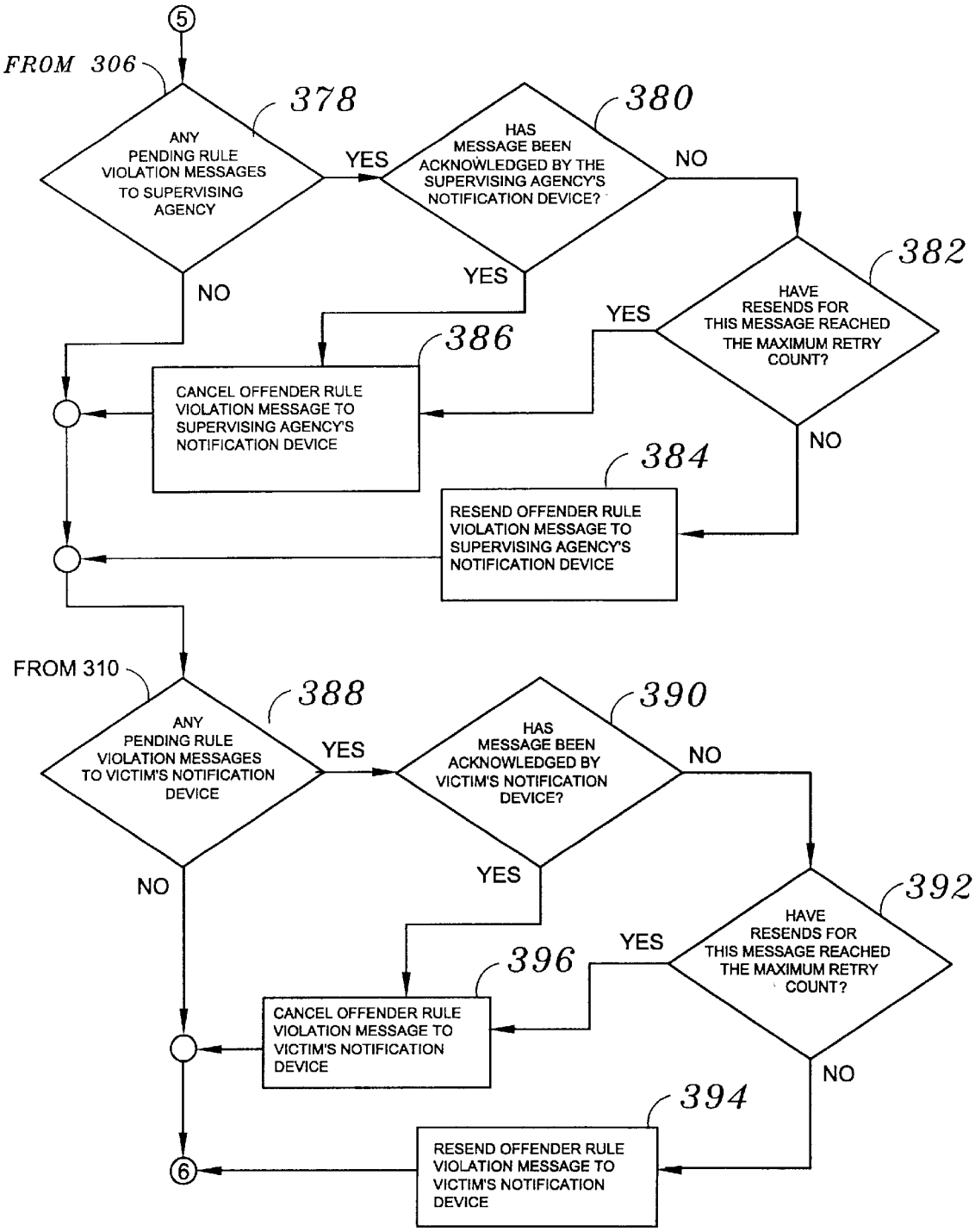
Figure 4F:
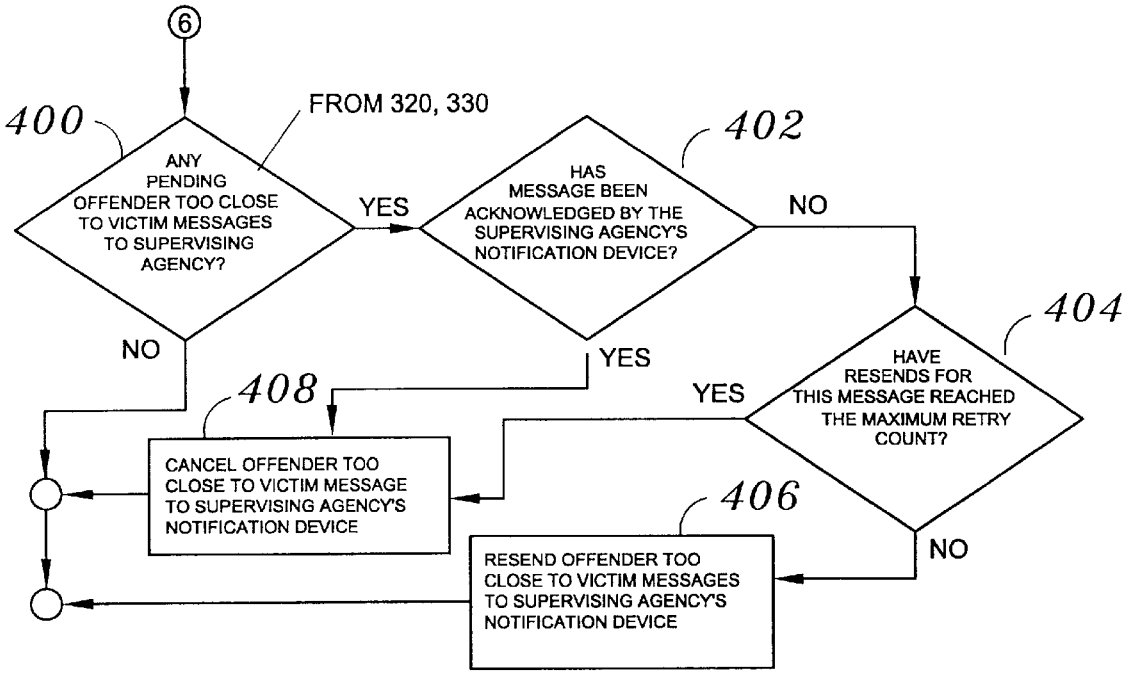

Throughout the following detailed description, the same reference numerals refer to the same elements in all figures.

The portable tracking apparatus in FIG. 1 is described in U.S. Pat. No. 5,731,757 incorporated herein by reference. FIG. 2 and FIG. 3 algorithms are extensions to the algorithms present in the portable tracking apparatus described by U.S. Pat. No. 5,731,757. FIG. 4 algorithms are extensions to the central data base system algorithms described by U.S. Pat. No. 5,731,757.

FIG. 1 illustrates the overall system 10 incorporating a portable tracking device 12 which receives communication signals from a Global Positioning Satellite (GPS) 14 to determine the location of the subject (offender 16 or victim 18). When continuous location of the offender is desired, the offender 16 is fitted with a body-worn device which is non-removable by the offender 16 and provides tamper detection to generate alarms should the offender 16 attempt to remove the body-worn device 20. When the continuous location for the victim 18 is desired, the victim 18 can be provided a portable tracking device 12 and the body-worn device for the victim can be a garment clip-on version or an actual body-worn device.

The offender's portable tracking device 12 communicates with the body-worn device 20 over a wireless link. Tamper detection in the offender's body-worn device 20, tamper detection in the offender's portable tracking device 12, offender violation of location constraints or absence of the body-worn device 20 transmitted signal will generate an alarm on the offender's portable tracking device 12. The offender's portable tracking device 12 forwards the alarm to the central data base system 22 and any associated victim portable tracking devices 38 via the wireless link 32. The wireless network site 24 processes the wireless signal and switches the communication through the mobile switching office 26 to the central data base system 22 and any associated victim portable tracking devices 38.

The mobile switching office uses wireless communications 32,34,36,40,48,50, 62 and 64 through a network cell site 24 to provide communications between the offender's portable tracking device 12 and wireless personal communication service (PCS) notification devices such as digital cellular phones 44, police mobile data terminals 42 and digital alphanumeric pagers 46. The mobile switching office 26 uses either the public switched telephone network (PSTN) 28, a private network connection 52 or the Internet 48 to provide communications between the portable tracking devices 12, 38 and the central data base system 22. The redundant communication paths 28, 52 and 48 are dissimilar and improve the reliability and fault tolerance of communications with the central data base system. The mobile switching office 26 uses wireless communications 32,34,36, 40 through network cell sites 24 to provide communications between two or more portable tracking devices 12,38. The mobile switching office 26 uses wireless communications 32,64 through network cell sites 24 to provide communications directly between an offender's portable tracking device 12 and law enforcement's mobile data terminal 42. The wireless mobile switching office 26 uses wireless communications 32,50 through a network cell site 24 to provide communications between an offender's portable tracking device 12 and the supervising agency's pager notification device 46. The wireless mobile switching office 26 uses wireless communications 40,64 through a network cell site 24 to provide communications between a victim's portable tracking device 38 and law enforcement's mobile data terminal 42. The wireless mobile switching office 26 uses wireless communications 40,50 through a network cell site 24 to provide communications between a victim's portable tracking device 38 and the supervising agency pager 46.

The central data base system 22 communicates 54,56 with the supervising agency 30 using lease line, dial up or Internet. The central data base system 22 communicates with law enforcement 66 using land mobile dispatch radio interfaces or other wireless services 58,60 that support message packets.

The communications from the offender's portable tracking device 12 are routed to the central data base system 22 where response decisions for notification to the supervising agency (i.e. parole and probation, etc.) 30, victims 18 and law enforcement 42 are made based on offender schedule rules and location constraints defined by the supervising agency 30 and communicated 56 to the central data base system 22.

The central data base system 22 communicates to the offender's portable tracking device 12 via the wireless communication link 34 or a telephone land-line when not portable in order to load updated schedule rules and location constraints either new or modified. The central data base system 22 communicates to the victim's portable tracking device 38 via the wireless communication link 40 in order to facilitate communication messages from the supervising agency 30 and law enforcement 66. The central data base system 22 communicates to portable tracking devices 12 to load updates to the operating programs, schedule rules and location constraints for offenders 16. The central data base system 22 communicates to portable tracking devices 12 to load updates to the operating programs and safety parameters for victims 18.

The offender's portable tracking device 12 transmits location, health and status to the central data base system 22 using connectionless oriented wireless analog or digital message route 32 transitioning to terrestrial communication routes 28,48,52 at intervals defined by the supervising agency 30 and communicated 56 to the central data base system 22 where they are uploaded to the offender's portable tracking device 12. The offender's portable tracking device 12 transmits location, health and status to the victim's portable tracking device 38 using connectionless oriented wireless digital message packets 32, 36 at intervals defined by the supervising agency 30 and communicated 56 to the central data base system 22 where they are uploaded to the offender's portable tracking device 12. The victim's portable tracking device 38 transmits location, health and status to the central data base system 22 using connectionless oriented wireless analog or digital message packets 40, transitioning to terrestrial communication routes 28,48,52 at intervals defined by the supervising agency 30 and communicated 56 to the central data base system 22 where they are uploaded to the victim's portable tracking device 38. The victim's portable tracking device 38 transmits location, health and status to the offender's portable tracking device 12 using connectionless oriented wireless digital message packets 34 at intervals defined by the supervising agency 30 and communicated 56 to the central data base system 22 where they are uploaded to the victim's portable tracking device 38.

The offender's portable tracking device 12 transmits rule violation notification messages using connectionless oriented analog or digital wireless messages to:

the supervising agency's pager notification device 46 via 32,50, a the law enforcement agency's notification device 42 via 32,64, the central data base system 22 via 32, 28,48,52 and the victim's notification device 44 or 38 via 32,36.

The victim's portable tracking device 38 transmits notifications resulting from dynamic collision avoidance processing using connectionless oriented analog or digital wireless messages to:

the supervising agency's notification device 46 via 40,50, the law enforcement agency's notification device 42 via 40,64, and the central data base system 22 via 40,28,48,52.

FIGS. 2A–2E depict the iterative algorithm processing performed by the offender's 16 portable tracking device 12. The advanced warning and collision avoidance processing in the offender's portable tracking device starts with determining if there has been a rule violation 100 that has occurred regarding the offender's portable tracking device 12 and body-worn ankle transmitter 20. Offender rule violations can occur as a result of (1) offender location based on a schedule, (2) health of the portable tracking device 12 and body-worn ankle transmitter bracelet 20, and (3) status of tamper detection for the portable tracking device 12 and body-worn ankle bracelet 20.

Offender location rule violations based on time of day and day of week either place the offender 16 at a location that is off-limits or at a location other than where the offender 16 is required to be based on schedule and static location guidelines established by the supervising agency 30 and communicated 56 to the central data base system 22 where they are uploaded to the offender's portable tracking device 12.

Offender violations based on the health of the portable tracking device 12 and body-worn ankle transmitter bracelet 20 include battery levels, ability to receive GPS 14 signals and ability to receive wireless 24 communication signals.

Offender violations based on status of tamper detection in the portable tracking device 12 and body-worn ankle transmitter bracelet 20 include:

loss of body-worn device 20 signals by the portable tracking device 12, removal of the body-worn ankle transmitter bracelet 20, opening the case of the body-worn ankle transmitter bracelet 20, opening the case of the portable tracking device 12 and prolonged portable tracking device 12 movement with absence of GPS signals.

prolonged absence of wireless communication network signals.

prolonged absence of portable tracking device battery charging after notification.

The supervising agency 30 defines the following tamper detection intervals that are communicated 56 to the central data base system 22 where they are uploaded to the offender's portable tracking device 12:

loss of body worn device wireless signal, portable tracking device movement with absence of GPS signals, absence of wireless communication network signals, absence of portable tracking device battery charging after notification.

If there are any rule violations 100 for the offender, the offender's portable tracking device evaluates if there are victims that need to be notified 102 with a digital wireless notification device 44 using the connectionless oriented analog or digital wireless network 24. Based on the type of rule violation, the offender's portable tracking device 12 sends the appropriate rule violation message 104 to the victim's notification device 44 using a connectionless oriented analog or digital wireless message. If the offender's portable tracking device 12 determines 105 an associated victim has a portable tracking device 38, then the offender's portable tracking device 12 sends a rule violation message 107 to the victim's portable tracking device 38 using a connectionless oriented analog or digital wireless message 32,36. The central data base system 22, connected either to the Internet 48, a private network 52 supporting TCP/IP packets or the PSTN 28 is notified 106 by the offender's portable tracking device using a connectionless oriented analog or digital wireless message 32 which is routed, based on the destination address in the message, by the wireless mobile switching office. The offender's portable tracking device determines if a supervising agency 30 and or law enforcement agency 66 is notified 108 using a digital wireless notification device 46 or a notification device attached to a wireline communication network. Based on the type of rule violation, the offender's portable tracking device 12 sends the appropriate rule violation message 110 to the supervising agency's pager 46 and law enforcement agency's notification device 42 using a connectionless oriented analog or digital wireless message 32,50 and 32,64. The offender is notified 112 by audible alert and text message on the message display of the portable tracking device 12. If the supervising agency 30 or victim 18 do not have notification devices that support digital wireless communications, or the notification device is not operational, the central data base system 22 will notify them by current traditional methods such a phone, pager or Fax.

When the offender's portable tracking device 12 determines there has not been a rule violation 100, the offender's portable tracking device 12 assures that the update frequency established for the offender regarding location, health and status data (i.e. heartbeat) is provided 114 to the central data base system 22 and any associated victim's portable tracking device 38. Upon the offender's portable tracking device 12 determining that the offender's location, health and status data is required to be updated 114, the offender's portable tracking device 12 evaluates if there are any victim portable tracking devices 38 that require offender location, health and status data. The offender's location, health and status data is sent 118 to any associated victim's portable tracking device 38 using a connectionless oriented analog or digital wireless message. The offender's location is required for dynamic collision avoidance processing algorithms resident in the victim's 18 portable tracking device 38 processor and memory. The offender's 16 portable tracking device 12 will always send offender location, health and status data 115 to the central data base system 22 when the timestamp 114 expires.

The offender's portable tracking device 12 next examines the last known location 120 of any associated victim's portable tracking device 38 for dynamic (i.e. moving) collision avoidance between the offender 16 and victim 18. When the offender's portable tracking device 12 determines that the offender 16 is closer to the victim's last known position than the allowable distance requirements established for the offender 16 by the supervising agency 30, then the following occurs:

the offender's portable tracking device 12 sends offender location, health and status data 124 to the central data base system 22 using connectionless oriented analog or digital wireless services 32 and the Internet 48, a point-to-point PSTN 28 connection or a private network 52, the offender's portable tracking device 12 sends offender location, health and status data 122 to the victim's portable tracking device 38 using connectionless oriented analog or digital wireless services 32,36 to expedite location data fusion processing in the victim's portable tracking device 38, the offenders' portable tracking device 12 determines if the supervising agency 30, or law enforcement agency 66 has a notification device 126 and sends a digital message to the device or devices 46, 42 using connectionless oriented analog or digital wireless services 32,50, 64, the offender's portable tracking device 12 notifies the offender 16 to leave the area with an audible tone and a text message 130 on the offender's portable tracking device 12 display.

The allowable distance requirements for offender and victim proximity are defined by the supervising agency 30 and communicated to the central data base system 22 where they are uploaded to the offender's portable tracking device 12.

The offender's portable tracking device 12 evaluates if the last known position 132 sent by the victim's portable tracking device 38 is within the time requirements established by the supervising agency 30. If the victim's location data timestamp exceeds the requirement for latency time 132, then the offender's portable tracking device 12 sends the offender's location, health and status data 134 to the central data base system 22 using connectionless oriented analog or digital wireless services 32, transitioning to terrestrial communication routes 28,48,52.

Because connectionless oriented analog or digital wireless data messages are not confirmed for delivery, the offender's portable tracking device 12 implements acknowledgments by assigning packet sequence numbers as is known in the art in order to track message delivery acknowledgments from:

victim portable tracking devices 38, central data base system 22, digital wireless notification devices 42,44,46, Internet attached notification devices, PSTN attached notification devices and private network attached notification devices.

This implementation of end-to-end acknowledgment of connectionless oriented analog or digital wireless message service is required since there is no guaranteed delivery for connectionless oriented service. The determination of whether or not a connectionless oriented message sent by an offender's portable tracking device has been delivered is therefore implemented in the offender's portable tracking device 12.

The offender's portable tracking device 12 determines 138 if there are any pending acknowledgements for rule violation notification messages sent 104 to a victim's notification device 44. If rule violation messages have been sent to the victim's notification device 44, the offender's portable tracking device 12 checks if acknowledgment messages have been received 140 in the required time from the victim's notification device 44. If no acknowledgement has been received in the required time period 140, the offender's portable tracking device 12 checks if resends for the same message have reached a maximum retry count 142 to prevent message flooding for the same message. If the retry count maximum has not been reached 142, then the offender's portable tracking device 12 sends another 144 connectionless oriented analog or digital wireless message 32,36 to the victim's notification device 44. If the maximum retry count has been reached 142 or the message has been acknowledged 140, then the offender's portable tracking device 12 cancels the pending rule violation message acknowledgement expected 146 from the victim's notification device 44. The maximum retry count 142 for sending the offender rule violation message to the victim's notification device 44 is defined by the central data base system 22 and uploaded to the offender's portable tracking device 12.

The offender's portable tracking device 12 determines 148 if there are any pending acknowledgements for rule violation notification messages sent 110 to a supervising agency's pager 46. If rule violation messages have been sent to the supervising agency's pager 46, the offender's portable tracking device 12 checks if acknowledgement messages have been received 148 in the required time from the supervising agency's notification device 46. If no acknowledgement has been received in the required time period 150, the offender's portable tracking device 12 checks if resends for the same message have reached a maximum retry count 152 to prevent message flooding for the same message. If the maximum retry count has not been reached 152, then the offender's portable tracking device 12 sends another 154 connectionless oriented analog or digital wireless message 32,50 to the supervising agency's notification device 46. If the maximum retry count has been reached 152 or the message has been acknowledged 150, then the offender's portable tracking device 12 cancels the pending rule violation message acknowledgment expected 156 from the supervising agency's notification device 46. The maximum retry count 152 for sending the offender rule violation message to the supervising agency's notification device 46 is defined by the central data base system 22 and uploaded to the offender's portable tracking device 12.

The offender's portable tracking device 12 determines 158 if there are any pending acknowledgments for rule violation notification messages sent 106 to the central data base system 22. If rule violation messages have been sent to the central data base system 22, the offender's portable tracking device 12 checks if an acknowledgment messages have been received 158 in the required time from the central data base system 22. If no acknowledgment has been received in the required time period 160, the offender's portable tracking device 12 checks if resends for the same message have reached a maximum retry count 162 to prevent message flooding for the same message. If the maximum retry count has not been reached 162 or the message has been acknowledged 160, then the offender's portable tracking device 12 sends another 164 connectionless oriented analog or digital wireless message 32, transitioning to communication routes 52, 28, 48 to the central data base system 22. If the retry count maximum has been reached 162, then the offender's portable tracking device 12 cancels the pending rule violation message acknowledgment expected 166 from the central data base system 22. The maximum retry count 162 for sending the offender rule violation message to the central data base system 22 is defined by the central data base system 22 and uploaded to the offender's portable tracking device 12.

The offender's portable tracking device 12 determines 168 if there are any pending acknowledgments for location, health and status messages sent to a victim's portable tracking device 38. If location, health and status messages have been sent to the victim's portable tracking device 38, the offender's portable tracking device 12 checks if acknowledgment messages have been received 170 in the required time from the victim's portable tracking device 38. If no acknowledgments have been received in the required time period 170, the offender's portable tracking device 12 checks if resends for the same message have reached a maximum retry count 172 to prevent message flooding for the same message. If the retry count maximum has not been reached 172, then the offender's portable tracking device 12 sends another 174 connectionless oriented analog or digital wireless message 32,36 to the victim's portable tracking device 38. If the maximum retry count has been reached 172 or the message has been acknowledged 170, then the offender's portable tracking device 12 cancels the pending offender's location, health and status message acknowledgment expected 176 from the victim's portable tracking device 38. The maximum retry count 172 for sending the offender location, health and status message to the victim's portable tracking device 38 is defined by the central data base system 22 and uploaded to the offender's portable tracking device 12.

The offender's portable tracking device 12 determines 178 if there are any pending acknowledgments for location, health and status messages sent 124,134 to the central data base system 22. If location, health and status messages have been sent to the central data base system 22, the offender's portable tracking device 12 checks if acknowledgment messages have been received 180 in the required time from the central data base system 22. If no acknowledgments have been received in the required time period 180, the offender's portable tracking device 12 checks if resends for the same message have reached a maximum retry count 182 to prevent message flooding for the same message. If the maximum retry count has not been reached 182 or the message has been acknowledged 180, then the offender's portable tracking device 12 sends another 184 connectionless oriented analog or digital wireless message 32, transitioning to terrestrial communication routes 52,28,48 to the central data base system 22. If the retry count maximum has been reached 182, then the offender's portable tracking device 12 cancels the pending offender's location, health and status message acknowledgment expected 186 from the central data base system 22. The maximum retry count 182 for sending the offender location, health and status message to the central data base system 22 is defined by the central data base system 22 and uploaded to the offender's portable tracking device 12.

The offender's portable tracking device 12 determines if any victim location, health and status connectionless oriented messages 40,34 have been received 188 from a victim's portable tracking device 38. If victim's location, health and status connectionless oriented messages have been received 188, the offender's portable tracking device 12 sends the victim's portable tracking device 190 a connectionless oriented analog or digital wireless message 32,36 to acknowledge the sequence number of the message for the victim's portable tracking device 38.

FIGS. 3A–3E depict the iterative algorithm processing performed by the victim's portable tracking device 38. The advanced warning and collision avoidance processing in the victim's portable tracking device 38 starts by determining 200 if sufficient time has elapsed for the victim's portable tracking device 38 to report 202 its location, health and status to the central data base system 22. If required, the victim's portable tracking device 38 will send its location, health and status to the central data base system 22 using a connectionless oriented analog or digital wireless message 40, transitioning to terrestrial communication routes 28,48, 52. The victim's portable tracking device 38 will then send its location, health and status to any associated offender's portable tracking device 12 using a connectionless oriented analog or digital wireless message 40,34 to facilitate advanced collision avoidance processing 120 in the offender's portable tracking device 12.

The victim's portable tracking device 38 determines 204 if any offender's portable tracking device 12 has sent a rule violation message 107. The victim's portable tracking device 38 will notify 206 the victim 18 with an audible tone and a text message describing the nature of the rule violated by the offender 16. The victim's portable tracking device 38 will send an acknowledgment message 208 to the offender's portable tracking device 12 using a connectionless oriented analog or digital wireless message 40,34. The victim's portable tracking device 38 will send a message 210 to the central data base system 22 that the victim's portable tracking device 38 has processed the received offender's rule violation message 206 using a connectionless oriented analog or digital wireless message 40, transitioning to terrestrial communication routes 28,48,52. The victim's portable tracking device 38 will determine if the supervising agency 212 has a notification device. If the supervising agency 30, or law enforcement agency 66 has a notification device, the victim's portable tracking device 38 will send a message 214 using a connectionless oriented analog or digital wireless message 40,50, 64 that the victim's portable tracking device has processed the received offender rule violation message 206.

The victim's portable tracking device 38 determines 216 if a location, health and status message 118 has been received from an associated offender's portable tracking device 12. For a received message, the victim's portable tracking device 38 performs location data fusion processing and computes if the proximity 218 of the offender 16 is within the safety perimeter established for the victim 18 by the supervising agency 30. The proximity requirements defined by the supervising agency 30 are communicated 56 to the central data base system 22 where they are uploaded to the victim's portable tracking device 38. Should the victim's portable tracking device 38 determine the offender is too close 218 to the victim 18, then the victim's portable tracking device 38 will alert the victim with an audible tone and a text message 220 indicating the offender's distance, direction and heading. The victim's portable tracking device 38 will send 222 a connectionless oriented analog or digital wireless message 40, transitioning to terrestrial communication routes 28,52,48 to the central data base system 22. The victim's portable tracking device 38 will determine if the supervising agency or law enforcement agency 224 has a notification device. If the supervising agency has a notification device, the victim's portable tracking device 38 will send a message 226 that the victim's portable tracking device 38 has determined that the offender 16 has moved too close 218 to the victim 18 using a connectionless oriented analog or digital wireless message 40,50, 64. The victim's portable tracking device 38 will send an acknowledgment 228 to the offender's portable tracking device 12 using a connectionless oriented analog or digital wireless message 40,34.

The victim's portable tracking device 38 determines if the maximum time has elapsed 230 since an offender's portable tracking device 12 has sent a location, health and status message to the victim's portable tracking device 38. If the maximum time defined by the supervising agency 30 has elapsed, the victim's portable tracking device 38 notifies the victim with an audible tone and a text message indicating contact lost 232 with the offender's portable tracking device 12. The maximum time defined by the supervising agency 30 is communicated 56 to the central data base system 22 where it is uploaded to the victim's portable tracking device.

The victim's portable tracking device sends a message to the central data base system 234 notifying of an offender contact lost condition using a connectionless oriented analog or digital wireless message 40, transitioning to terrestrial communication routes 28,48,52. The victim's portable tracking device 38 will determine if the supervising agency or law enforcement agency 236 has a notification device. If the supervising agency has a notification device, the victim's portable tracking device 38 will send a message 238 that the victim's portable tracking device 38 has an offender contact lost condition using a connectionless oriented analog or digital wireless message 40,50, 64.

Because connectionless oriented analog or digital wireless data messages are not confirmed for delivery, the victim's portable tracking device 38 implements acknowledgments by assigning packet sequence numbers as is known in the art in order to track message delivery acknowledgments from:

offender portable tracking devices 12, central data base system 22, digital wireless notification devices 42,46

Internet attached notification devices

PSTN attached notification devices and

Private network attached notification devices. This implementation of end-to-end acknowledgment of connectionless oriented analog or digital wireless message service is required since there is no guaranteed delivery for connectionless oriented service. The determination of whether or not a connectionless oriented message sent 222 by the victim's portable tracking device 38 has been delivered is therefore implemented in the victim's portable tracking device 38.

The victim's portable tracking device 38 determines 240 if there are any pending acknowledgments for offender 16 too close to victim 18 messages sent to the central data base system 22. If offender 16 too close to victim 18 messages have been sent to the central data base system 22, the victim's portable tracking device 38 checks if acknowledgment messages have been received 242 in the required time from the central data base system 22. If no acknowledgment message has been received 242 from the central data base system 22 in the required time period 242, the victim's portable tracking device 38 checks if resends for the same message have reached the maximum retry count 244 to prevent message flooding for the same message. If the maximum retry count has not been reached 244, then the victim's portable tracking device 38 sends another 246 connectionless oriented analog or digital wireless message 40, transitioning to terrestrial communication routes 28,48, 52 to the central data base system. If the maximum retry count has been reached 244 or the message has been acknowledged 242, then the victim's portable tracking device 38 cancels the pending offender 16 too close to victim 18 message acknowledgment expected 248 from the central data base system 22. The maximum retry count 244 for sending the offender 16 too close to victim 18 message is defined by the central data base system 22 and uploaded to the victim's portable tracking device 38.

The victim's portable tracking device 38 determines 250 if there are any pending acknowledgments for offender 16 too close to victim 18 messages sent 226 to the supervising agency's notification device 46. If offender 16 too close to victim 18 messages have been sent to the supervising agency's notification device 46, the victim's portable tracking device 38 checks if acknowledgment messages have been received 252 from the supervising agency's pager 46. If no acknowledgment message has been received 252 in the required time from the supervising agency's notification device 46 in the required time period 252, the victim's portable tracking device 38 checks if resends for the same message have reached the maximum retry count 254 to prevent message flooding for the same message. If the maximum retry count has not been reached 254, then the victim's portable tracking device 38 sends another 256 connectionless oriented analog or digital wireless message 40,50 to the supervising agency's notification device 46. If the maximum retry count has been reached 254 or the message has been acknowledged 252, then the victim's portable tracking device 38 cancels the pending offender 16 too close to victim 18 message acknowledgment expected 258 from the supervising agency's notification device 46. The maximum retry count 254 for sending the offender 16 too close to victim 18 message is defined by the central data base system 22 and uploaded to the victim's portable tracking device 38.

The victim's portable tracking device 38 determines 260 if there are any pending acknowledgments for contact lost with offender's portable tracking device 12 messages sent 234 to the central data base system 22. If contact lost with offender's portable tracking device 12 messages have been sent to the central data base system 22, the victim's portable tracking device 38 checks if acknowledgment messages have been received 262 from the central data base system 22. If no acknowledgment message has been received 262 in the required time from the central data base system 22 in the required time period 262, the victim's portable tracking device 38 checks if resends for the same message have reached the maximum retry count 264 to prevent message flooding for the same message. If the maximum retry count has not been reached 264, then the victim's portable tracking device 38 sends another 266 connectionless oriented analog or digital wireless message 40, transitioning to terrestrial communication routes 28,48,52 to the central data base system 22. If the maximum retry count has been reached 264 or the message has been acknowledged 262, then the victim's portable tracking device 38 cancels the pending contact lost with offender's portable tracking device 12 message acknowledgment expected 268 from the central data base system 22. The maximum retry count 264 for sending the contact lost with offender's portable tracking device 12 message is defined by the central data base system 22 and uploaded to the victim's portable tracking device 38.

The victim's portable tracking device 38 determines 270 if there are any pending acknowledgments for messages sent 210 to the central data base system 22 confirming that the victim's portable tracking device 38 has received an offender rule violation message. If the victim's portable tracking device 38 has sent a message to the central data base system 22 that it received an offender rule violation message, the victim's portable tracking device 38 checks if acknowledgment messages have been received 272 in the required time from the central data base system 22. If no acknowledgment message has been received 272 from the central data base system 22 in the required time period 272, the victim's portable tracking device 38 checks if resends for the same message have reached the maximum retry count 274 to prevent message flooding for the same message. If the maximum retry count has not been reached 274, then the victim's portable tracking device 38 sends another 276 connectionless oriented analog or digital wireless message 40, transitioning to terrestrial communication routes 28,48, 52 to the central data base system 22. If the maximum retry count has been reached 274 or the message has been acknowledged 272, then the victim's portable tracking device 38 cancels the pending message to the central data base system 22 that the victim's portable tracking device 38 has received an offender rule violation 278. The maximum retry count 274 for sending victim's portable tracking device 38 has received offender rule violation message is defined by the central data base system 22 and uploaded to the victim's portable tracking device 38.

The victim's portable tracking device 38 determines 280 if there are any pending acknowledgments for contact lost with offender's portable tracking device 12 messages sent 238 to the supervising agency's notification device 46. If contact lost with offender's portable tracking device 12 messages have been sent to the supervising agency's notification device 46, the victim's portable tracking device 38 checks if acknowledgment messages have been received 282 in the required time from the supervising agency's notification device 46. If no acknowledgment message has been received 282 from the supervising agency's notification device 46 in the required time period 282, the victim's portable tracking device 38 checks if resends for the same message have reached the maximum retry count 284 to prevent message flooding for the same message. If the maximum retry count has not been reached 284, then the victim's portable tracking device 38 sends another 286 connectionless oriented analog or digital wireless message 40,50 to the supervising agency's notification device 46. If the maximum retry count has been reached 284 or the message has been acknowledged 282, then the victim's portable tracking device 38 cancels the pending contact lost with offender's portable tracking device 12 message acknowledgment expected 288 from the supervising agency's notification device 46. The maximum retry count 284 for sending the contact lost with offender's portable tracking device 12 message is defined by the central data base system 22 and uploaded to the victim's portable tracking device 38.

The victim's portable tracking device 38 determines 290 if there are any pending acknowledgments for messages sent 214 to the supervising agency' notification device 46 that the victim's portable tracking device 38 has received offender rule violation messages. If the victim's portable tracking device 38 has sent a message to the supervising agency's notification device 46 that it has received an offender rule violation message, the victim's portable tracking device 38 checks if acknowledgment messages have been received 292 in the required time from the supervising agency's notification device 46. If no acknowledgment message has been received 292 from the supervising agency's notification device 46 in the required time period 292, the victim's portable tracking device 38 checks if resends for the same message have reached the maximum retry count 294 to prevent message flooding for the same message. If the maximum retry count has not been reached 294, then the victim's portable tracking device 38 sends another 296 connectionless oriented analog or digital wireless message 40,50 to the supervising agency's notification device 46. If the maximum retry count has been reached 294 or the message has been acknowledged 292, then the victim's portable tracking device 38 cancels the pending message to the supervising agency's notification device 46 that the victim's portable tracking device has received an offender rule violation message 298. The maximum retry count 294 for sending victim's portable tracking device 38 has received an offender rule violation message is defined by the central data base system 22 and uploaded to the victim's portable tracking device 38.

FIGS. 4A–4F depict the iterative algorithm processing performed by the central data base system 22. The advanced warning and collision avoidance processing at the central data base system 22 starts with determining 300 if any offender rule violation messages have been received from an offender's portable tracking device 12 as a result of the offender's portable tracking device determining that a rule violation has occurred 100. The central data base system 22 will send an acknowledgment message 302 to the offender's portable tracking device 38 for the rule violation message 106 using a connectionless oriented analog or digital wireless message 28, transitioning to terrestrial communication routes 48,52,34. The central data base system 22 determines 304 if any notification to a supervising agency 30 or law enforcement agency 66 is required. If required, the central data base system 22 will notify 306 the supervising agency 30 and law enforcement agency 66 by current traditional means such as Fax, pager or phone and/or by a connectionless oriented analog or digital wireless message 28, transitioning to terrestrial communication routes 48,52,50 to the supervising agency wireless notification device 46 and 28, transitioning to terrestrial communication routes 48,52,64 to the law enforcement agency wireless notification device 42. The central data base system 22 determines 308 if any notification to a victim 18 is required. If required, the central data base system will notify 310 the victim 18 by current traditional means such as pager or phone and/or by a connectionless oriented analog or digital wireless message 28, transitioning to terrestrial communication routes 48,52, 36 to the victim's wireless notification device 44.

The central data base system 22 determines if an offender's portable tracking device 12 has sent a location, health and status message 312 as a result of advanced collision avoidance processing 124,115 in the offender's portable tracking device 12. If a message has been received, the central data base system 22 sends an acknowledgment message 314 to the offender's portable tracking device 12 for the location, health and status message sent 124,115 by the offender's portable tracking device 12 using a connectionless oriented analog or digital wireless message 28, transitioning to terrestrial communication routes 48,52,34. The central data base system 22 determines 316 if there are any associated victims 18 with portable tracking devices 38. If there are associated victim portable tracking devices 38, then the central data base system 22 compares the last known location of the victim 18 to the current reported location of the offender 16. If the central data base system 22 determines the offender's position has penetrated the dynamic safety perimeter 318 established by the supervising agency 30 for the victim 18, then the central data base system 22 performs the following:

- notifies 320 the supervising agency 30 by current traditional means such as Fax, pager or phone and/or by a connectionless oriented analog or digital wireless message 28, transitioning to terrestrial communication routes 48,52,50 to the supervising agency wireless notification device 46.
- notifies 320 the victim 18 with an audible tone and a text message on the victim's portable tracking device 38 with the time, distance and heading of the offender 16 using a connectionless oriented analog or digital wireless message 28, transitioning to terrestrial conmnunication routes 48,52,36.

The central data base system 22 determines if victim's portable tracking device 38 has sent a location, health and status message 324 as a result of advanced collision avoidance processing 202 in the victim's portable tracking device 38. If a message has been received, the central data base system 22 sends an acknowledgment message 326 to the victim's portable tracking device 38 for the location, health and status message sent 202 by the victim's portable tracking device 38 using a connectionless oriented analog or digital wireless message 28,48,52,36. The central data base system 22 compares the last known location of the offender 16 to the current reported location of the victim 18. If the central data base system 22 determines the offender's position has penetrated the dynamic safety perimeter 328 established by the supervising agency 30 for the victim 18, then the central data base system 22 performs the following:

notifies 330 the supervising agency 30 by current traditional means such as Fax, pager or phone and/or by a connectionless oriented analog or digital wireless message 28,48,52,50 to the supervising agency wireless notification device 46.

notifies 332 the victim 18 with an audible tone and a text message on the victim's portable tracking device 38 with the time, distance and heading of the offender 16 using a connectionless oriented analog or digital wireless message 28, transitioning to terrestrial communication routes 48,52,36.

The central data base system 22 determines if victim's portable tracking device 38 has sent a message 210 indicating that it has received a rule violation message 334 from the offender's portable tracking device 12. If a message has been received, the central data base system 22 sends an acknowledgment message 336 to the victim's portable tracking device 38 for the message sent 210 by the victim's portable tracking device 38 using a connectionless oriented analog or digital wireless message 28, transitioning to terrestrial communication routes 48,52,36. The central data base system 22 determines 338 if any supervisory agency 30 notification is required. If required, the central data base system 22 notifies 340 the supervising agency 30 by current traditional means such as Fax, pager or phone and/or by a connectionless oriented analog or digital wireless message 28, transitioning to terrestrial communication routes 48,52,50 to the supervising agency pager 46.

The central data base system 22 determines if victim's portable tracking device 38 has sent a message 222 indicating that it has received an offender too close message 342 from the offender's portable tracking device 12. If a message has been received, the central data base system 22 sends an acknowledgment message 344 to the victim's portable tracking device 38 for the message sent 222 by the victim's portable tracking device 38 using a connectionless oriented analog or digital wireless message 28, transitioning to terrestrial communication routes 48,52,36. The central data base system 22 determines 346 if any supervisory agency 30 notification is required. If required, the central data base system 22 notifies 348 the supervising agency 30 by current traditional means such as Fax, pager or phone and/or by a connectionless oriented analog or digital wireless message 28, transitioning to terrestrial communication routes 48,52,50 to the supervising agency wireless notification device 46.

The central data base system 22 determines if victim's portable tracking device 38 has sent a message 234 indicating that it has lost contact 350 with the offender's portable tracking device 12. If a message has been received, the central data base system 22 sends an acknowledgment message 352 to the victim's portable tracking device 38 for the message sent 234 by the victim's portable tracking device 38 using a connectionless oriented analog or digital wireless message 28, transitioning to terrestrial communication routes 48,52,36. The central data base system 22 determines 354 if any supervisory agency 30 notification is required. If required, the central data base system 22 notifies 356 the supervising agency 30 by current traditional means such as Fax, pager or phone and/or by a connectionless oriented analog or digital wireless message 28, transitioning to terrestrial communication routes 48,52,50 to the supervising agency wireless notification device 46.

The central data base system 22 determines if any offender's portable tracking device 12 is past due sending a location, health and status message 358. If the offender's location, health and status message is past due, the central data base system 22 determines if any supervising agency 30 needs to be notified 360. If required, the central data base system 22 notifies 366 the supervising agency 30 by current traditional means such as Fax, pager or phone and/or by a connectionless oriented analog or digital wireless message 28, transitioning to terrestrial communication routes 48,52,50 to the supervising agency wireless notification device 46. The central data base system 22 determines if any victim notification is required 362. If required, the central data base system 22 notifies 364 the victim 18 by current traditional means such as pager or phone and/or by a connectionless oriented analog or digital wireless message 28, transitioning to terrestrial communication routes 48,52,36 to the victim's wireless notification device 46 or the victim's portable tracking device 38. The central data base system 22 will then make attempts to contact 368 the offender's portable tracking device 12 by current traditional means such as connection oriented circuit switched wireless and/or by a connectionless oriented analog or digital wireless message 28, transitioning to terrestrial communication routes 48,52,34.

The central data base system 22 determines if any victim's portable tracking device 38 is past due sending a location, health and status message 370. If the victim's location, health and status message is past due, the central data base system 22 determines if any supervising agency 30 needs to be notified 372. If required, the central data base system 22 notifies 374 the supervising agency 30 by current traditional means such as Fax, pager or phone and/or by a connectionless oriented analog or digital wireless message 28, transitioning to terrestrial communication routes 48,52,50 to the supervising agency wireless notification device 46. The central data base system 22 will then make attempts to contact 376 the victim's portable tracking device 38 by current traditional means such as connection oriented circuit switched wireless and/or by a connectionless oriented analog or digital wireless message 28, transitioning to terrestrial communication routes 48,52,36.

Because connectionless oriented analog or digital wireless data messages are not confirmed for delivery, the central data base system 22 implements acknowledgments by assigning packet sequence numbers as is known in the art in order to track message delivery acknowledgments from;

offender portable tracking devices 12, victim portable tracking devices 38, digital wireless notification devices 42,44,46, Internet attached notification devices, PSTN attached notification devices and private network attached notification devices.

This implementation of end-to-end acknowledgment of connectionless oriented analog or digital wireless message service is required since there is no guaranteed delivery for connectionless oriented service. The determination of whether or not a connectionless oriented message sent by the central data base system 22 has been delivered is therefore implemented in the central data base system 22.

The central data base system 22 determines 378 if there are any pending acknowledgments for messages sent 306 to the supervising agency' notification device 46 that the central data base system 22 has received offender rule violation messages. If the central data base system 22 has sent a message to the supervising agency's notification device 46 that it has received an offender rule violation message, the central data base system 22 checks if acknowledgment messages have been received 380 from the supervising agency's notification device 46. If no acknowledgment message has been received 380 in the required time from the supervising agency's notification device 46 in the required time period 380, the central data base system 22 checks if resends for the same message have reached the maximum retry count 382 to prevent message flooding for the same message. If the maximum retry count has not been reached 382, then the central data base system 22 sends another 384 connectionless oriented analog or digital wireless message 28, transitioning to communication routes 48,52,50 to the supervising agency's notification device 46. If the maximum retry count has been reached 382 or the message has been acknowledged 380, then the central data base system 22 cancels the pending message to the supervising agency's notification device 46 that the central data base system has received an offender rule violation message 386.

The central data base system 22 determines 388 if there are any pending acknowledgments for messages sent 310 to the victim's notification device 44 that the central data base system 22 has received offender rule violation messages. If the central data base system 22 has sent a message to the victim's notification device 44 that it has received an offender rule violation message, the central data base system 22 checks if acknowledgment messages have been received 390 in the required time from the victim's notification device 44. If no acknowledgment message has been received 390 from the victim's notification device 44 in the required time period 390, the central data base system 22 checks if resends for the same message have reached the maximum retry count 392 to prevent message flooding for the same message. If the maximum retry count has not been reached 392, then the central data base system 22 sends another 394 connectionless oriented analog or digital wireless message 28, transitioning to terrestrial communication routes 48,52, 36 to the victim's notification device 44. If the maximum retry count has been reached 392 or the message has been acknowledged 390, then the central data base system 22 cancels the pending message to the victim's notification device 44 that the central data base system has received an offender rule violation message 396.

The central data base system 22 determines 400 if there are any pending acknowledgments for messages sent 320, 330 to the supervising agency's notification device 46 that the central data base system 22 has determined the offender is too close to the victim. If the central data base system 22 has sent a message to the supervising agency's notification device 46 that the offender is too close to the victim, the central data base system 22 checks if acknowledgment messages have been received 402 in the required time from the supervising agency's notification device 46. If no acknowledgment message has been received 402 from the supervising agency's notification device 44 in the required time period 402, the central data base system 22 checks if resends for the same message have reached the maximum retry count 404 to prevent message flooding for the same message. If the maximum retry count has not been reached 404, then the central data base system 22 sends another 406 connectionless oriented analog or digital wireless message 28, transitioning to terrestrial communication routes 48,52, 50 to the supervising agency's notification device 46. If the maximum retry count has been reached 404 or the message has been acknowledged 402, then the central data base system 22 cancels the pending message to the supervising agency's notification device 46 that the offender is too close to the victim 408.

Equivalent elements can be substituted for the elements employed in this invention to obtain substantially the same results in substantially the same way.

Having described the invention what is claimed for Letters Patent is:

1. An offender and victim collision avoidance and advanced warning system employing an offender's portable tracking apparatus responsive to a message from a wireless communication system for determining its own spatial coordinates from a Global Positioning System and communicating with an offender's body worn device and a central data base, the advanced warning system additionally comprising:

(a) means in the offender's portable tracking apparatus to communicate simultaneously with a victim's portable tracking apparatus while communicating with the central data base;

(b) means in the offender's portable tracking apparatus to communicate simultaneously with a law enforcement entity and the offender's supervisory authority while communicating with the central data base; and (c) means in the offender's portable tracking apparatus for confirming delivery of communications among the offender, the victim, the central data base, the law enforcement entity and the offender's supervisory authority.

2. The warning system according to claim 1 wherein the means to communicate in (a) and (b) is connectionless oriented analog or digital wireless signal.

3. The warning system according to claim 1 wherein the communications are accomplished through a mobile switching office receiving and transmitting a digital or analog wireless signal.

4. The warning system according to claim 1 wherein the offender's portable tracking apparatus simultaneously sends a tamper signal to the central data base, the victims portable tracking device, the law enforcement entity and the offender's supervisory authority during a prolonged absence of a wireless signal from the body worn device.

5. The warning system according to claim 1 wherein means for providing redundant communication is provided among the offender, victim, central data control, the law enforcement entity and the supervisory authority.

6. The warning system according to claim 1 wherein a memory card stored in the offender's portable tracking apparatus provides a schedule of rules and location constraints to determine if a static violation by the offender has occurred.

7. The warning system according to claim 6 wherein the memory card additionally compares the current location of the offender's portable tracking apparatus to the location of a victim's portable tracking apparatus to determine if a dynamic violation has occurred and generates a warning signal to the victim if a constraint contained in the memory card is violated.

8. An offender and victim collision avoidance and advanced warning system using a tamper resistant offender's portable tracking device and an associated tamper resistant body worn device for use in a wireless communications system, the offender's portable tracking device determining its own spatial coordinates from a Global Positioning System, conveying its spatial coordinates to an associated portable tracking device and a central data base system, receiving spatial coordinates from the associated portable tracking device, sending messages through wireless digital notification devices, receiving responses from wireless digital notification devices and the offender's portable tracking device having (a) a means to communicate using connectionless oriented analog or digital wireless messages directly and simultaneously with the associated portable tracking device, a digital wireless notification device, a central data base system and a wireline communication network notification device, and (b) a means to communicate using circuit switched connection oriented digital or analog wireless signals with the central data base system.

9. The warning system according to claim 8 wherein the offender's portable tracking device additionally includes a memory card and a processor for use with algorithms to (1) compare the current location of the offender's portable tracking device to a schedule of rules and location constraints stored in the memory card to determine if a static violation has occurred, (2) perform location data fusion processing by comparing the current location of the offender's portable tracking device against the location of the associated portable tracking device to determine if a dynamic violation has occurred, (3) generate instructional commands to an offender, (4) generate warning information messages to a victim, (5) generate notification messages to a supervising agency, law enforcement agency and a central data base system, (6) determine when the location and status message of the offender's portable tracking device is required to be sent, (7) determine when the location and status message of the associated portable tracking device is past due and (8) provide assured delivery of messages to offenders, victims, supervising agencies, law enforcement agencies, and central data base system.

10. The warning system according to claim 9 wherein the supervising agency creates or updates the schedule of rules and location constraints for the memory card in the offender's portable tracking device by uploading data to the memory card in the offender's portable tracking device using either connection oriented circuit switched signals or connectionless oriented analog or digital wireless messages.

11. The warning system according to claim 9 wherein the supervising agency creates or updates the victim's dynamic safety perimeter for the offender's portable tracking device by uploading data to the memory card in the offender's portable tracking device using either connection oriented circuit switched signals or connectionless oriented analog or digital wireless messages.

12. In a method for use with a wireless communication system to determine by spatial coordinates the location of an offender's portable tracking apparatus adapted to communicate with the offender's body-worn device and a central data base, including the steps of:

(a) providing multiple redundant communication paths to the central data base and from the central data base to the offender's portable tracking device, and (b) providing simultaneous communication to a victim's portable tracking apparatus.

13. The method according to claim 12 wherein there is additionally provided a means to confirm delivery of a connectionless message to the, offender's portable tracking apparatus, a victim's portable tracking apparatus, a law enforcement entity, an offender's supervisory agency and central data base via the wireless communication system.

14. The method according to claim 12 wherein there is additionally provided simultaneous communication to a law enforcement entity via the wireless communication system.

15. The method according to claim 12 wherein there is additionally provided simultaneous communication to an offender's supervisory authority via the wireless communication system.

16. The method according to claim 12 wherein the offender's portable tracking apparatus is provided with a memory card comparing the current location of the offender's portable tracking apparatus to a schedule of rules and location constraints stored in the memory card to determine if a static constraint violation has occurred.

17. The method according to claim 16 wherein the memory card contains instructions for performing location data fusion processing by comparing the current location of the offender's portable tracking apparatus against the location of a victim's portable tracking apparatus to determine if a dynamic violation has occurred.

18. The method according to claim 12 wherein one communication path to the central data base and the victim's portable tracking apparatus is provided by a connectionless oriented analog or digital wireless signal.

19. The method according to claim 12 wherein one communication path to the central data base provided by a circuit switched connection oriented digital or analog wireless signal.

20. The method according to claim 12 wherein a signal from the central data base to the offender's portable tracking device uploads data to a memory card in the offender's portable tracking device.

21. The method according to claim 20 wherein the signal is provided by a connectionless oriented analog or digital wireless message.

22. The method according to claim 20 wherein the signal is provided by a connection oriented circuit switched message.

* * * * *